US008109260B2

(12) United States Patent
Maeda

(10) Patent No.: US 8,109,260 B2
(45) Date of Patent: Feb. 7, 2012

(54) TOY GUN

(75) Inventor: Tetsuo Maeda, Tokyo (JP)

(73) Assignee: Maruzen Company Limited, Tokyo (JP)

( * ) Notice: Subject to any disclaimer, the term of this patent is extended or adjusted under 35 U.S.C. 154(b) by 64 days.

(21) Appl. No.: 12/801,471

(22) Filed: Jun. 10, 2010

(65) Prior Publication Data

US 2011/0048395 A1 Mar. 3, 2011

(30) Foreign Application Priority Data

Aug. 28, 2009 (JP) ..... 2009-198006

(51) Int. Cl.
*F41B 11/00* (2006.01)

(52) U.S. Cl. ..... 124/73

(58) Field of Classification Search ..... 124/73–77
See application file for complete search history.

(56) References Cited

U.S. PATENT DOCUMENTS

| | | | | |
|---|---|---|---|---|
| 4,936,282 | A * | 6/1990 | Dobbins et al. | 124/74 |
| 5,078,118 | A * | 1/1992 | Perrone | 124/74 |
| 5,257,614 | A * | 11/1993 | Sullivan | 124/73 |
| 5,339,791 | A * | 8/1994 | Sullivan | 124/73 |
| 5,349,938 | A * | 9/1994 | Farrell | 124/73 |
| 5,476,087 | A | 12/1995 | Kunimoto | |
| 5,477,843 | A | 12/1995 | Kunimoto | |
| 5,778,868 | A * | 7/1998 | Shepherd | 124/76 |
| 2004/0089280 | A1 * | 5/2004 | Kunimoto | 124/76 |
| 2005/0028802 | A1 * | 2/2005 | Jones | 124/73 |
| 2005/0115550 | A1 * | 6/2005 | Jones | 124/65 |
| 2005/0115554 | A1 * | 6/2005 | Jones | 124/74 |
| 2006/0027221 | A1 * | 2/2006 | Farrell | 124/31 |
| 2006/0162711 | A1 | 7/2006 | Maeda et al. | |
| 2006/0169265 | A1 | 8/2006 | Lai | |
| 2007/0209650 | A1 * | 9/2007 | Jones | 124/73 |
| 2007/0227519 | A1 * | 10/2007 | Wood | 124/73 |

FOREIGN PATENT DOCUMENTS

| | | |
|---|---|---|
| GB | 2 439 798 A | 1/2008 |
| JP | 10-197200 A | 7/1998 |

OTHER PUBLICATIONS

Extended European Search Report, App. No. 10005244.8-1260, Aug. 2, 2010 (4 pages).

* cited by examiner

*Primary Examiner* — Troy Chambers
(74) *Attorney, Agent, or Firm* — Rader, Fishman & Grauer PLLC

(57) ABSTRACT

A bolt has a cylindrical fit receiving portion. When the bolt slides forward, the rear part of a valve body enters the fit receiving portion. At a closed end opposed to its opening behind the fit receiving portion, a cylindrical body is provided. The cylindrical body lets the interior of the bolt and the exterior of the bolt communicate with each other. The shank of an opening/closing body is slidably placed in the cylindrical body. This opening/closing body has an lid portion at the end of the shank on the fit receiving portion side and a coming-off preventing portion at the outside end of the shank. An opening/closing body spring is placed between the closed end of the bolt and the lid portion and pushes the lid portion toward the fit receiving portion.

3 Claims, 19 Drawing Sheets

TOY GUN

CROSS REFERENCE TO RELATED APPLICATION

The present application is based on and claims the benefit of priority of Japanese Patent Application No. 2009-198006 filed on Aug. 28, 2009, the entire contents of which is incorporated herein by reference.

TECHNICAL FIELD

The present invention relates to a toy gun so configured that pressure arising from compressed gas is applied to a bullet to fire it off by a user pulling the trigger.

BACKGROUND

There are conventionally toy guns so configured that pressure arising from compressed gas is applied to a bullet to fire it off by a user pulling the trigger. (An example is the automatic toy gun described in Japanese Unexamined Patent Publication No. Hei 10 (1998)-197200.) This type of toy gun is used by toy gun enthusiasts for fun in target shooting (plinking) or the like at home.

The automatic toy gun described in Japanese Unexamined Patent Publication No. Hei 10 (1998)-197200 is of open bolt type. Brief description will be given to the action of a forward/backward action bolt 11 observed when bullets are fired off from this automatic toy gun. When the trigger 1 is pulled with the forward/backward action bolt 11 in a standby position close to the rear end of the gun, the following takes place: a recoil spring 27 pushes the forward/backward action bolt 11 and a hammer 21 integrally provided on the forward/backward action bolt 11 hits a opening/closing valve member 51. As the result of hitting by the hammer 21, a bullet BB receives gas pressure and is accelerated in the direction toward the front end of a gunbarrel 2 and fired off from the gun. Substantially immediately after the bullet BB is fired off from the gunbarrel 2, the forward/backward action bolt 11 starts to move back in turn due to gas pressure from an accumulator 50 and the biasing force of a rebound spring 29.

Many toy gun users request of a toy gun that it not only fires off bullets but also provides functions and the sense of use similar to those of real guns. In a toy gun so configured that a valve is opened and closed in conjunction with the movement of a bolt in the back and forth direction of a gunbarrel and a bullet is thereby loaded and fired off, the following is implemented: high impact is produced by the movement of the bolt and this makes it possible to obtain the sense of use close to that of a real gun. For this reason, toy guns so configured that a bolt is moved and bullets are thereby fired off are more popular than toy guns with a fixed bolt.

The toy gun described in Japanese Unexamined Patent Publication No. Hei 10 (1998)-197200 is so configured that the following is implemented: a bolt moves forward and hits a valve and thereby opens the valve to fire off a bullet; and after the bolt thereafter moves back, the valve is closed. As mentioned above, this toy gun provides the sense of use close to that of a real gun. In case of this toy gun, however, the hammer, the valve, and bullets are not positioned in alignment. If the hammer, the valve, and bullets exist in alignment, it must be possible to further reduce the size of a bullet firing mechanism and more efficiently apply gas pressure to bullets. Aside from the automatic toy gun described in Japanese Unexamined Patent Publication No. Hei 10 (1998)-197200, an open bolt-type toy gun in which a hammer, a valve, and bullets exist substantially in alignment is possible. This will be designated as toy gun in virtual case.

This toy gun in virtual case is equipped with a movable bolt. This bolt has at its rear part a space (variable volume pressure chamber) into which air or gas flows. This variable volume pressure chamber is a space into which gas flows after a bullet is fired off. Gas that flowed into this variable volume pressure chamber pushes the bolt backward by its pressure. As long as the variable volume pressure chamber is filled with gas, the gas continuously pushes the bolt backward. That is, the above bolt moves backward after a bullet is fired off. This bolt breaks away from a valve body immediately before it arrives at the backmost retreat position. This removes the airtightness in the bolt and the gas in the variable volume pressure chamber is discharged to the atmosphere. As a result, the pressure of the gas in the variable volume pressure chamber is reduced.

For this reason, the following takes place in the toy gun in virtual case: the time for which the bolt continuously receives pressure from gas is lengthened as the closed-end cylindrical portion forming the variable volume pressure chamber becomes longer. As a result, the recoil shock given to the user by the toy gun in virtual case is also increased.

However, lengthening the closed-end cylindrical portion poses another problem. As the closed-end cylindrical portion becomes longer, the distance the bolt travels until it hits the hammer after it is fit into the closed-end cylindrical portion is lengthened. As a result, the air in the closed-end cylindrical portion functions as if it were a buffer material (air cushion) and this reduces the impact by which the bolt hits the hammer. If the recoil spring is strengthened to increase the impact by which the hammer is hit to solve the above problem, a new problem would arise. The recoil shock produced when the bolt is moved backward by gas pressure is reduced.

SUMMARY

Accordingly, an object of the present invention is to produce high impact when a bullet is fired off with a toy gun so configured that a bullet is fired off by gas pressure and at the time of blowback and further simultaneously achieve smooth bullet firing and blowback actions.

According to the present invention, A toy gun includes a barrel extended in the back and forth direction of a gunbarrel, a valve body formed in the shape of a cylinder extended in the back and forth direction of the gunbarrel, having an air chamber to be filled with compressed gas formed therein, communicating with the rear-side end of the barrel on the front side, and having a through hole penetrating the valve body in the back and forth direction of the gunbarrel formed on the rear side, a discharge valve positioned in the valve body and so provided that the discharge valve can be displaced between a closed position where the communication between the barrel and the air chamber is shut and an open position, located in front of the closed position, where the communication between the barrel and the air chamber is opened, a discharge valve spring pushing the discharge valve backward and positioning the discharge valve in the closed position, a bolt provided so that the bolt can freely slide in the back and forth direction of the gunbarrel, including a fit receiving portion which has an opening and to which the outer circumferential surface of the valve body on the rear side is fit through the opening and an abutment portion provided on the bottom portion of the fit receiving portion opposite the opening, and displaced between a pressing position where the abutment portion is abutted against the discharge valve and the discharge valve is positioned in the open position and a retreat position, behind this pressing position, where the abutment portion is caused to break away from the discharge valve, a bolt spring pushing the bolt forward, a communicating portion provided at the bottom portion of the bolt, an opening/closing body including a slidable shank which is inserted into the communicating portion and forms an air gap between the shank and the inner circumferential surface of the communicating portion, a lid portion which is provided at the front end of the shank and has such a shape as to cover the communicating portion, and a coming-off preventing portion which is provided on the shank and prevents the opening/closing body from coming off forward, and an opening/closing body spring pushing the opening/closing body forward.

DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION

Description will be given to an embodiment with reference to FIG. 1 to FIG. 15. This embodiment will be designated as first embodiment for the convenience of explanation. This embodiment is an example in which the invention is applied to a continuous firing toy gun.

Figure 1:
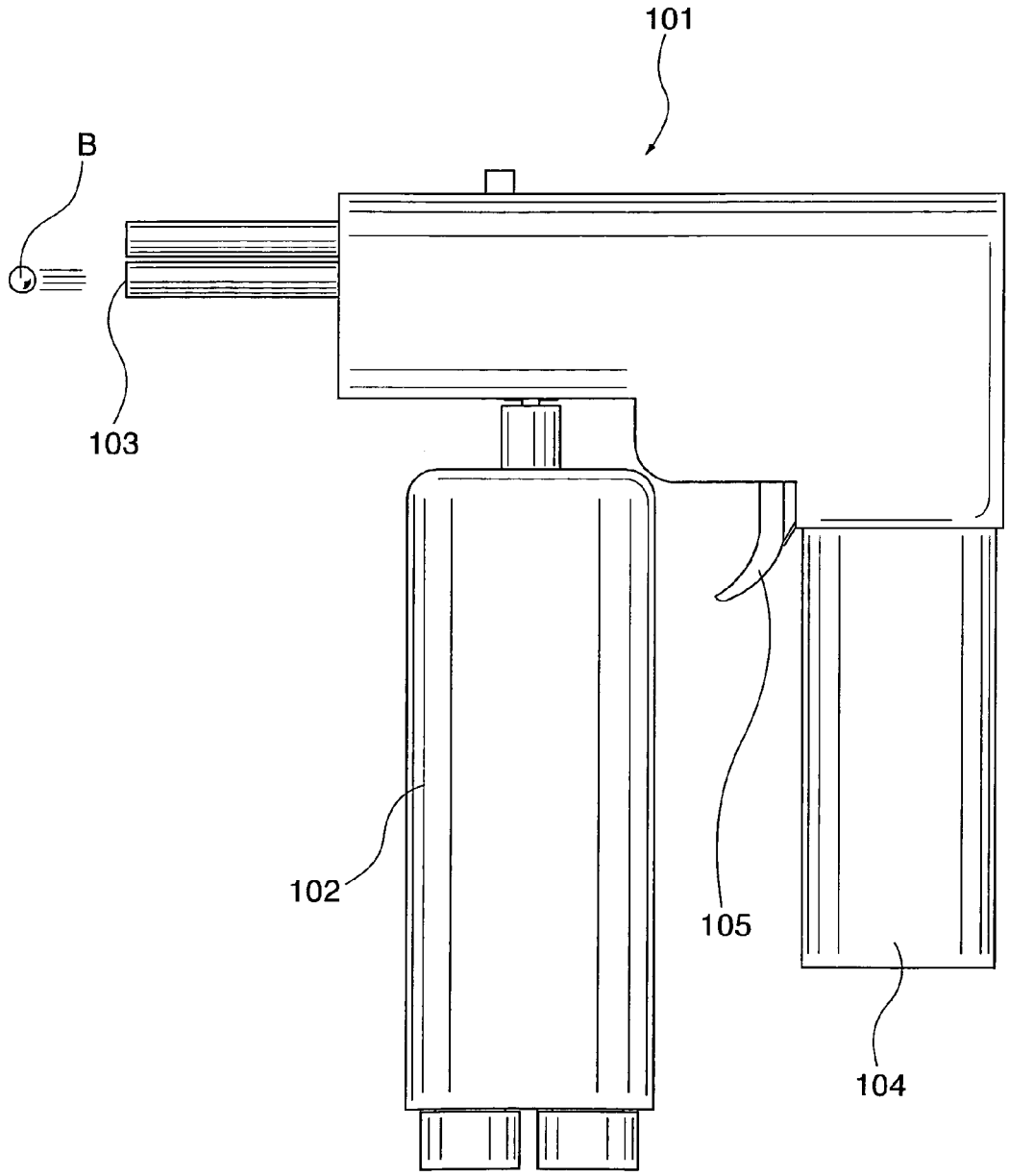
FIG. 1 is a left side view of a toy gun in a first embodiment.

FIG. 1 is a left side view of the toy gun 101. The toy gun 101 in this embodiment is a continuous firing toy gun used with a compressed gas cylinder 102 attached thereto. This toy gun 101 is so configured that the pressure of compressed gas filled in the compressed gas cylinder 102 is applied to a bullet B and the bullet B is thereby fired off from a muzzle 103. To use the toy gun 101, a user grasps its grip 104 with his/her hand and puts his/her finger on the trigger 105 and aims the muzzle 103 at a shooting target (for example, a mark). Then the user can fire off a bullet B from the muzzle 103 by moving his/her finger to pull the trigger 105 to the rear side of the toy gun 101.

Figure 2:
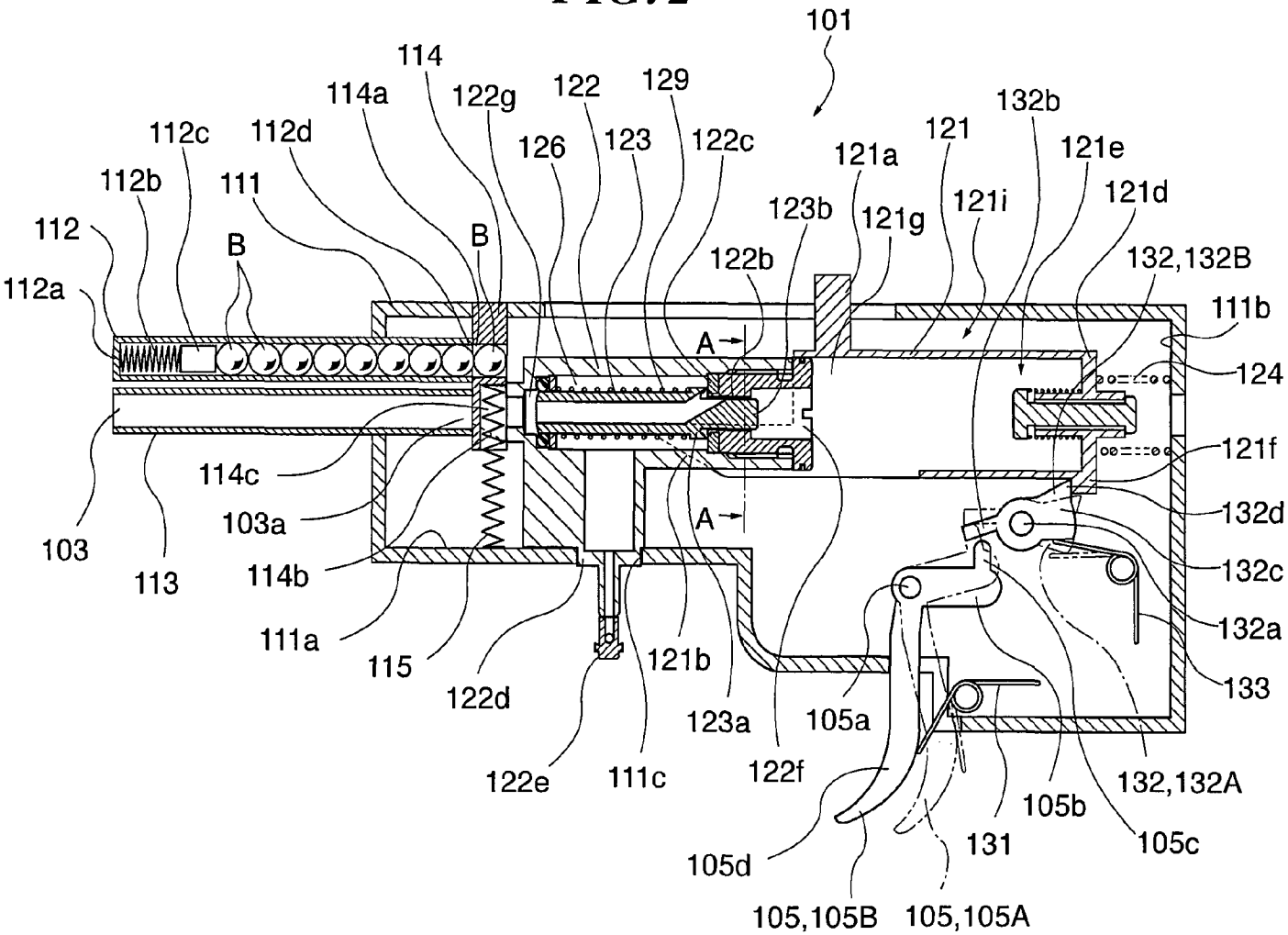
FIG. 2 is a left sectional view illustrating the internal structure of a toy gun in the first embodiment.

FIG. 2 is a left sectional view illustrating the internal structure of the toy gun 101. In FIG. 2 and FIG. 12 to FIG. 15, the compressed gas cylinder 102 and the grip 104 are omitted. In the following description, the side on which the muzzle 103 is positioned will be designated as the front side of the toy gun 101 and the side on which the grip 104 is positioned will be designated as the rear side of the toy gun 101.

First, description will be given to each part provided in the front portion of the toy gun 101. The toy gun 101 includes a frame 111 that forms an enclosure, a magazine 112, a barrel 113, and a bullet feed plate 114. In this embodiment, the frame 111 forms part of the gunbarrel and defines the back and forth direction of the toy gun 101. The magazine 112 and the barrel 113 are protruded from the frame 111 forward of the toy gun 101. The magazine 112 and the barrel 113 may be not protruded from the frame 111 but be housed in the frame.

The magazine 112 is a cylindrical member with one end being a closed end 112*a* and is capable of housing bullets B therein. A magazine spring 112*b* is attached to the inner side face of the closed end 112*a* in the magazine 112. At the end of the magazine spring 112*b* on the opposite side to the closed end 112*a*, a magazine follower 112*c* that pushes bullets B is attached. Bullets B are guided into the magazine 112 through an open end 112*d* of the magazine 112. Instead, an opening may be provided in the magazine 112 in an appropriate place other than the open end 112*d* and a bullet B may be guided in through this opening. The magazine 112 with bullets B housed therein is attached to the front side of the frame 111 with its open end 112*d* pointed backward of the toy gun 101. The magazine 112 may be detachable from the frame 111 or may be fixed in the frame.

The barrel 113 is a cylindrical member and extended in the back and forth direction of the gunbarrel. The front end of the barrel 113 is the muzzle 103. The inside diameter of the barrel 113 is slightly larger than the diameter of each bullet B. The barrel 113 is positioned under the magazine 112 on the front side of the frame 111.

The bullet feed plate 114 is a rectangular parallelepiped member. The bullet feed plate 114 is perpendicular to the magazine 112 and is placed in the frame 111. The bullet feed plate 114 is supported by a guide member (not shown) placed in the frame 111 and can be moved in the vertical direction. The open end 112*d* face of the magazine 112 attached to the frame 111 and the open end 103*a* face of the barrel 113 on the opposite side to the muzzle 103 are abutted against the surface of the bullet feed plate 114 facing forward.

The bullet feed plate 114 has a bullet retention hole 114*a* in a position opposite the open end 112*d* of the magazine 112. This bullet retention hole 114*a* is a hole in a size sufficient to house a bullet B. The lower end face of the bullet feed plate 114 is coupled to a bullet feed plate spring 115. The other end of the bullet feed plate spring 115 on the opposite side to the bullet feed plate 114 is coupled to the inner bottom face 111*a* of the frame 111. The bullet feed plate spring 115 pushes the bullet feed plate 114 upward and opposes the bullet retention hole 114*a* to the open end 112*d* of the magazine 112.

The bullet feed plate 114 has a slope 114*b* at its lower part. The slope 114*b* is inclined so that it ascends form the rear to the front of the toy gun 101. The bullet feed plate 114 has a space 114*c* through which the tip portion of a bolt 121 (described later) can pass above the slope 114*b*.

A bullet B in the magazine 112 attached to the frame 111 is pushed out by the magazine follower 112*c* due to the biasing force of the magazine spring 112*b*. It is then housed in the bullet retention hole 114*a* in the bullet feed plate 114. When the bolt 121 advances forward and pushes the bullet feed plate 114 downward, the bullet B is positioned in a position opposite the open end 103*a* of the barrel 113. (Refer to FIG. 12.) When a discharge valve 123 (described later) jets out compressed gas forward in this state, the bullet B is pushed out forward. It passes through the interior of the barrel 113 and is shot forward out of the muzzle 103. (Refer to FIG. 13.)

Description will be given to each part provided in the middle of the toy gun 101 with reference to FIG. 2. The toy gun 101 has, in the frame 111, the bolt 121, a valve body 122, the discharge valve 123, a bolt spring 124, packing 122*c*, and the discharge valve spring 129.

The bolt 121 is a cylindrical member extended in the back and forth direction of the toy gun 101. The bolt 121 is so provided that it can freely slide in the back and forth direction of the toy gun 101 and can reciprocate between a pressing position 121A (Refer to FIG. 5) and a retreat position 121B (Refer to FIG. 4). While it reciprocates once in the back and forth direction, the bolt 121 is abutted against and breaks away from the discharge valve 123 and thereby opens and shuts the communication between the barrel 113 and an air chamber 126 (described later).

The bolt 121 has an opening 121*g* open forward. The bolt 121 has at its rear part a closed end 121*d* that forms the bottom portion opposite the opening 121*g*. The bolt 121 has a fit receiving portion 121*i* at its rear part. The fit receiving portion 121*i* has the opening 121*g* and the closed end 121*d* at both its ends and its side face is cylindrically covered. The outer circumferential surface of the valve body 122 on the rear side is fit into this fit receiving portion 121*i* through the opening 121*g*.

The bolt 121 has a protruded portion 121*a* protruded upward from its upper surface. The lower part of the bolt 121 on the opening 121*g* side is extended forward. The bolt 121 has a forward slope 121*b* on the under surface of this portion extended forward. The forward slope 121*b* is inclined upward as it goes from the rear to the front.

One end of the bolt spring 124 is abutted against the outer surface of the closed end 121*d* of the bolt 121. The other end of the bolt spring 124 is abutted against the inner surface 111*b* of the rear part of the frame 111. The bolt spring 124 pushes forward the bolt 121 positioned in the retreat position 121B. (Refer to FIG. 4 as well.) This retreat position 121B will be described later with reference to FIG. 4. When the bolt spring 124 pushes the bolt 121 forward, the bolt 121 is caused to slide forward. Then the bolt brings the forward slope 121*b* of the bolt 121 into slide contact with the slope 114*b* of the bullet feed plate 114 to push the bullet feed plate 114 downward. Though detailed description will be given later, the bolt 121 that moved forward and pushed the bullet feed plate 114 downward makes the following movement: the bolt receives the pressure of compressed gas passing through an air gap S (described later) between a through hole 122*b* and a slide projection 123*b* and moves backward. The bolt 121 makes reciprocating motion and repeats the forward movement and the backward movement as mentioned above.

The bolt 121 has a locking projection 121*f*. The locking projection 121*f* is extended from the under surface on the closed end 121*d* side.

The bolt 121 has an abutment portion 121*e* on the inside surface side of the closed end 121*d*. The abutment portion 121*e* is fit into a fitting hole 122*f* (described next) located at the rear end of the valve body 122.

The valve body 122 is a cylindrical member extended in the back and forth direction of the gunbarrel and forms therein the air chamber 126 to be filled with compressed gas. The outside diameter of the valve body 122 is smaller than the inside diameter of the bolt 121. The valve body 122 enters the bolt 121 through the opening 121*g* and can freely slide in the back and forth direction in the bolt 121. In the area at the front part of the toy gun 101 in the space in the valve body 122, a space 122*g* is ensured for the discharge valve 123 (described later) to slide forward.

The valve body 122 has a rear lid 122*a* at its rear end. The ring-shaped packing 122*c* is attached to the end face of the rear lid 122*a* facing forward. The rear lid 122*a* has the through hole 122*b*. The through hole 122*b* penetrates the rear lid in the back and forth direction of the gunbarrel and lets the exterior of the valve body 122 and the interior of the discharge valve 123 communicate with each other. The rear part of the through hole 122*b* forms the fitting hole 122*f* large in inside diameter. The abutment portion 121*e* provided on the bolt 121 is fit into the fitting hole 122*f* from outside the valve body 122. A slide projection 123*b* (described later) provided on the discharge valve 123 enters the through hole 122*b* from inside the valve body 122. This slide projection 123*b* is protruded to the fitting hole 122*f* side.

Figure 3:
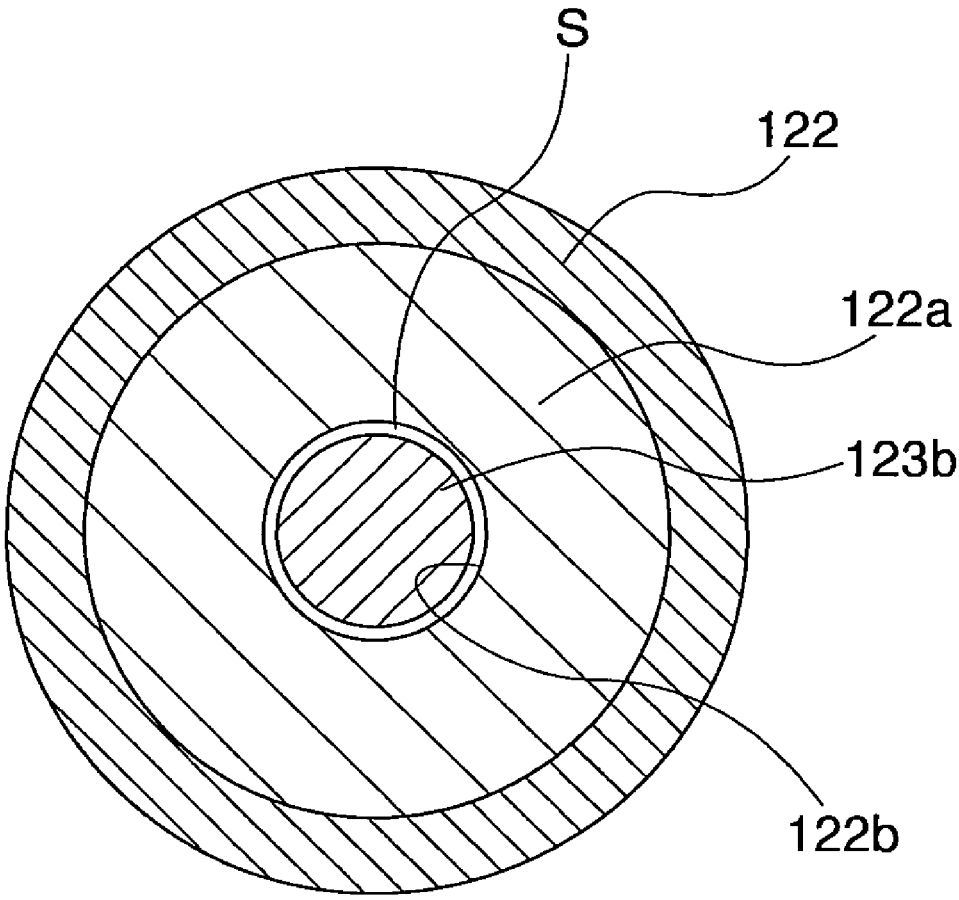
FIG. 3 is a sectional view taken along line A-A of FIG. 2.

FIG. 3 is a sectional view taken along line A-A of FIG. 2. The slide projection 123*b* has such a shape that it can enter the through hole 122*b* in the rear lid 122*a*. When it enters the through hole 122*b*, the slide projection 123*b* forms an air gap S between it and the inner circumferential surface of the through hole 122*b*.

Description will be given with reference to FIG. 2 again. The valve body 122 has a gas introducing portion 122*d*. The gas introducing portion 122*d* is protruded downward from the under surface of the valve body 122. The gas introducing portion 122*d* is hollow and lets the space in the valve body 122 and the space outside the frame 111 communicate with each other. The gas introducing portion 122*d* is fit into an attachment hole 111*c* formed in the inner bottom face 111*a* of the frame 111. As a result, the tip 122*e* of the gas introducing portion 122*d* is protruded downward of the frame 111. The compressed gas cylinder 102 (not shown in FIG. 2) is attached to this tip 122*e* of the gas introducing portion 122*d*. The compressed gas cylinder 102 feeds compressed gas into the valve body 122 through this gas introducing portion 122*d*.

The discharge valve 123 is a cylindrical member and its front end face is open. The outside diameter of the discharge valve 123 is smaller than the inside diameter of the valve body 122. This discharge valve 123 is positioned in the valve body 122 and forms the air chamber 126 between the valve body 122 and the discharge valve 123.

The discharge valve 123 has a flange portion 123*a* and a slide projection 123*b* at its rear end area. The flange portion 123*a* is protruded from the outer circumferential surface of the discharge valve 123 in the radial direction. The slide projection 123*b* is protruded from the rear end face of the discharge valve 123.

Figure 4:
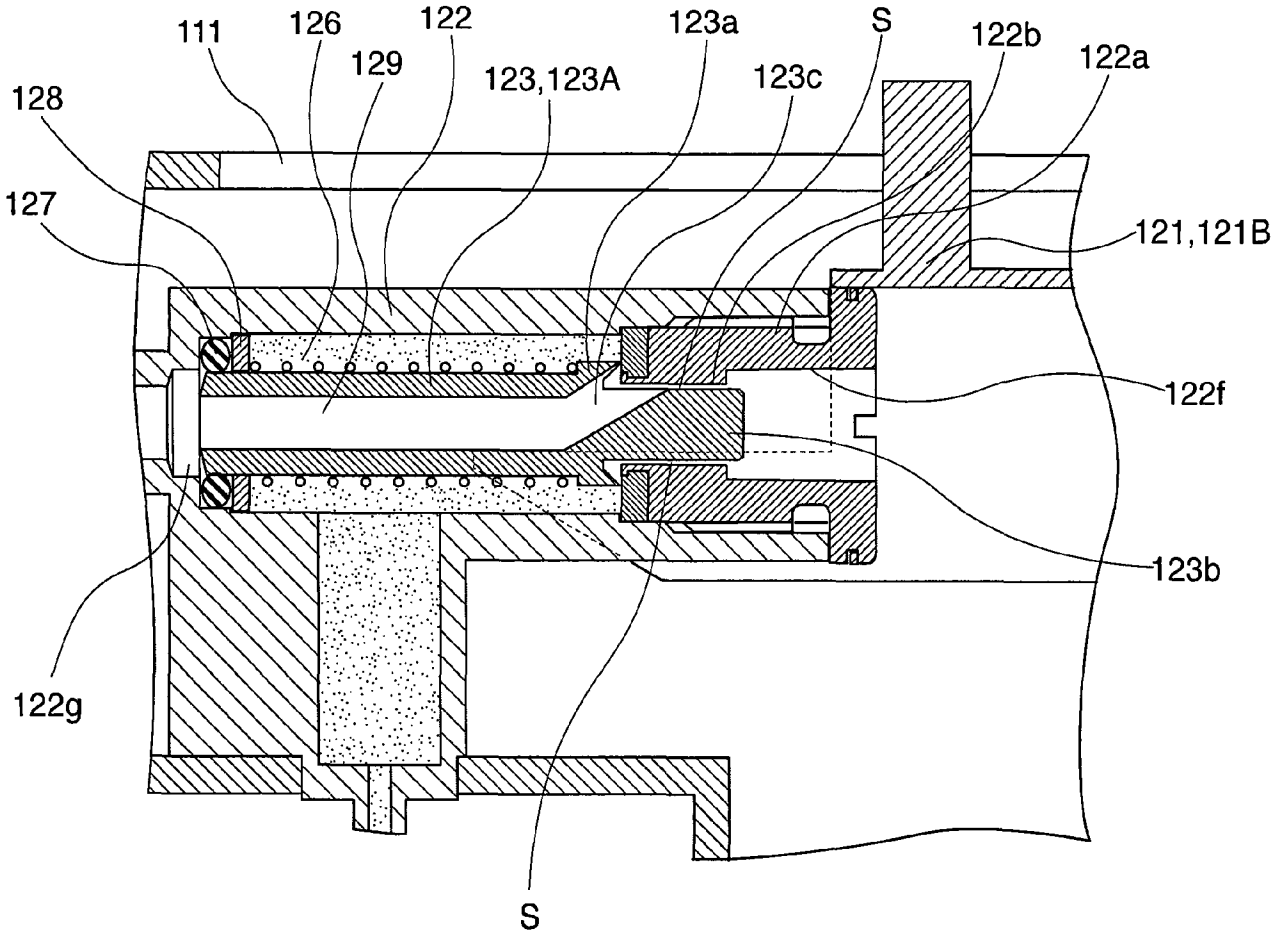
FIG. 4 is a left side view illustrating how a discharge valve shuts the communication between a barrel and an air chamber in the first embodiment.

FIG. 4 is a left side view illustrating how the discharge valve 123 shuts the communication between the barrel 113 and the air chamber 126. The dot meshed portions in FIG. 4 indicate areas filled with compressed gas. The discharge valve 123 has a communicating passage 123*c*. The communicating passage 123*c* is a cylindrical space inclined from the direction in which the internal space of the discharge valve 123 is extended. One end of the communicating passage 123*c* communicates with the internal space of the discharge valve 123. An opening at the other end of the communicating passage 123*c* appears between the flange portion 123*a* and the slide projection 123*b*.

In the front end area of the outer circumferential surface of the discharge valve 123, an O-ring 127 and a washer 128 are installed. As illustrated in FIG. 2, the O-ring 127 is sandwiched between the washer 128 and the inner wall of the valve body 122. The washer 128 is positioned next to the rear part of the O-ring 127. One end of the discharge valve spring 129 is brought into contact with the rear surface of the washer 128. The discharge valve spring 129 is placed so that it is wound around the discharge valve 123. The other end of the discharge valve spring 129 is brought into contact with the flange portion 123*a*. The discharge valve spring 129 pushes the washer 128 and thereby presses the O-ring 127 against the inner wall of the valve body 122. Further, the discharge valve spring 129 pushes the flange portion 123*a* of the discharge valve 123 backward to press the flange portion 123*a* against the packing 122*c* and thereby positions the discharge valve 123 in a closed position 123A. At this time, the air chamber 126 becomes air-tight. In this state, gas introduced from the gas introducing portion 122*d* into the air chamber 126 does not leak from the front part or rear part of the valve body 122.

In FIG. 4, the bolt 121 is positioned in the retreat position 121B at the rear part of the toy gun 101. The retreat position 121B refers to a position of the bolt 121 where the abutment portion 121*e* is caused to break away from the slide projection 123*b* of the discharge valve 123. At this time, the discharge valve 123 is pushed backward by the discharge valve spring 129.

Figure 5:
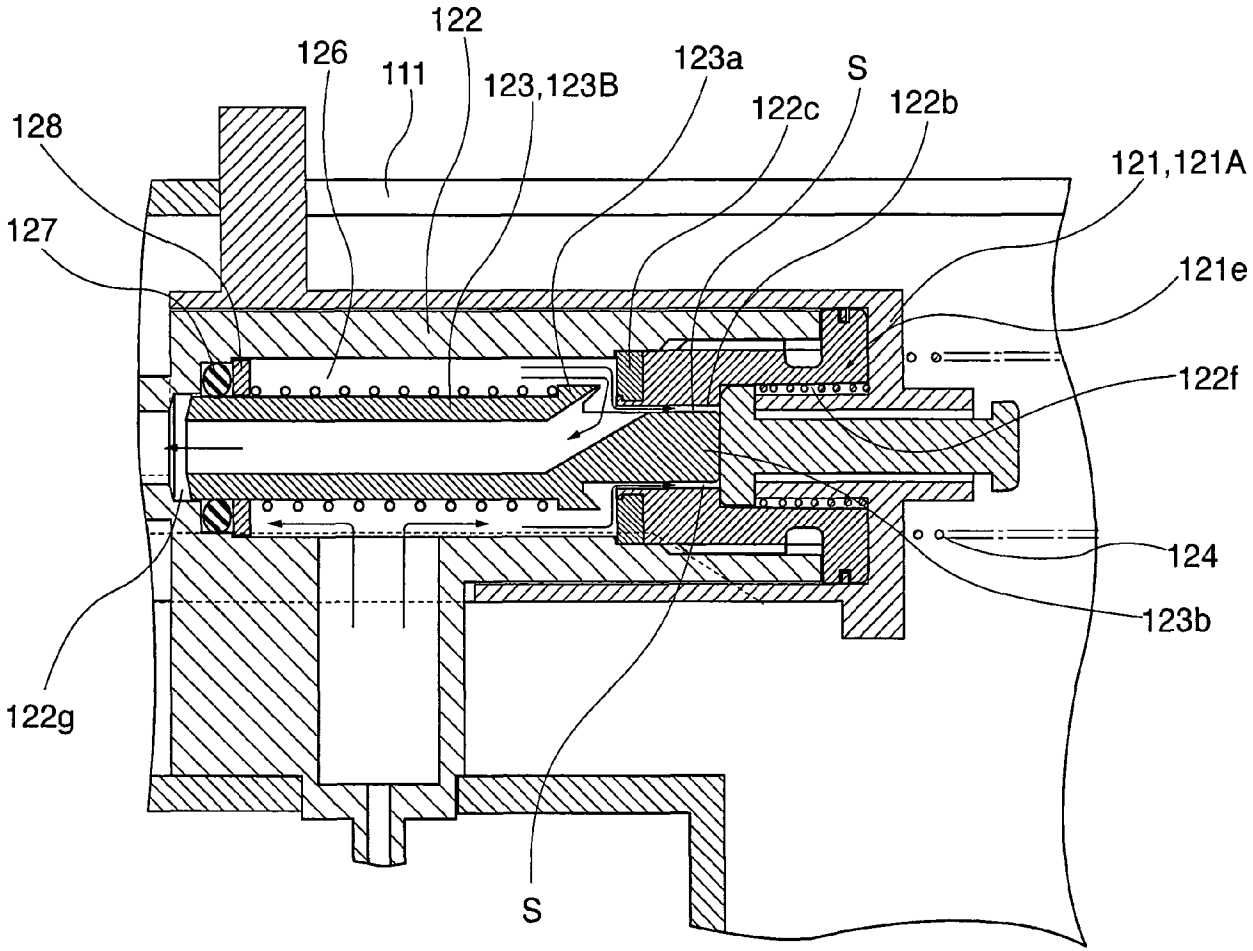
FIG. 5 is a left side view illustrating how the discharge valve opens the communication between the barrel and the air chamber in the first embodiment.

FIG. 5 is a left side view illustrating how the discharge valve 123 opens the communication between the barrel 113 and the air chamber 126. The arrows in FIG. 5 indicate the movement of compressed gas. In FIG. 5, the bolt 121 is positioned in the pressing position 121A at the front part of the toy gun 101. The pressing position 121A refers to a position of the bolt 121 where the abutment portion 121*e* is abutted against the slide projection 123*b* of the discharge valve 123 to push the discharge valve 123 forward. At this time, the discharge valve 123 is moved forward and is positioned in an open position 123B where the communication between the discharge valve 123 and the air chamber 126 is opened. When the bolt 121 is positioned in the open position 123B, the abutment portion 121*e* of the bolt 121 enters the fitting hole 122*f* and pushes the slide projection 123*b* forward. This causes the discharge valve 123 to slide toward the space 122*g* in the valve body 122. As a result, the flange portion 123*a* breaks away from the packing 122*c*. The compressed gas filled in the air chamber 126 flows into the internal space of the discharge valve 123 through a gap formed between the flange portion 123*a* and the packing 122*c* as indicated by arrows in FIG. 5. Then it is jetted forward out of the discharge valve 123 and pushes out the bullet B.

Further, when the flange portion 123*a* and the packing 122*c* break away from each other, the compressed gas also enters the air gap S and passes through the through hole 122*b* as indicated by arrows in FIG. 5. This compressed gas hits against the abutment portion 121*e* of the bolt 121 and the inner surface 111*b* (Refer to FIG. 2) of the rear part of the bolt 121 and pushes the bolt 121 backward.

When the discharge valve 123 moves forward, the discharge valve spring 129 pushes back the discharge valve 123. This causes the discharge valve 123 to slide backward and the flange portion 123*a* is brought into tight contact with the packing 122*c*. As a result, the air chamber 126 becomes air-tight again. In the air-tight state, the air chamber 126 is filled with compressed gas supplied from the compressed gas cylinder 102.

Description will be back to FIG. 2 again. Description will be given to each part provided in the rear portion of the toy gun 101. The toy gun 101 includes the trigger 105, a trigger spring 131, a bolt sear 132, and a bolt sear spring 133.

The trigger 105 is positioned in front of the grip 104 (not shown in FIG. 2). The trigger 105 is supported by the frame 111 so that it can be freely rotated around a fulcrum 105*a*. The trigger 105 can be freely displaced between a firing position 105A for firing bullets and a non-firing position 105B due to the fulcrum 105*a*. (The firing position is the position of the trigger 105 indicated by an alternate long and short dash line.) (The non-firing position is the position of the trigger 105 indicated by a solid line.) The trigger 105 has an operating portion 105*d* extended downward from the fulcrum 105*a*. Further, the trigger 105 has a backward extended portion 105*b* extended from the fulcrum 105*a* backward of the toy gun 101. The backward extended portion 105*b* has a bolt sear push-up portion 105*c* protruded upward from its upper surface.

The trigger spring 131 is positioned behind the operating portion 105*d*. The trigger spring 131 is attached to the frame 111. The trigger spring 131 pushes the trigger 105 clockwise and pushes the trigger 105 positioned in the firing position 105A back to the non-firing position 105B. When an operator pulls the operating portion 105*d* backward with his/her finger, the trigger 105 is positioned in the firing position 105A. When the operator thereafter removes his/her finger from the operating portion 105*d*, the trigger 105 is displaced to the non-firing position 105B.

The bolt sear 132 is provided above the bolt sear push-up portion 105*c* and under the bolt 121 in a position sandwiched between them. The bolt sear 132 is attached to the frame 111 so that it can be freely rotated around a shaft center 132*a*. The bolt sear 132 includes a flat plate-like forward protruded portion 132*b* and a backward protruded portion 132*c* fanned as laterally viewed. The forward protruded portion 132*b* is protruded forward of the shaft center 132*a*. The backward protruded portion 132*c* is protruded backward of the shaft center 132*a*. The upper part of the backward protruded portion 132*c* is a stopper portion 132*d* for stopping the locking projection 121*f* of the bolt 121. The bolt sear spring 133 is abutted against the under surface of the backward protruded portion 132*c*. The bolt sear spring 133 rotates the bolt sear 132 counterclockwise. When the bolt sear push-up portion 105*c* pushes upward the under surface of the forward protruded portion 132*b* in this bolt sear 132, the following takes place: the stopper portion 132*d* is displaced downward and the bolt sear 132 is positioned in a permission position 132A (the position of the bolt sear 132 indicated by an alternate long and short dash line). The permission position 132A refers to a position where the stopper portion breaks away from the path of the movement of the locking projection 121*f* of the bolt 121 and the reciprocating motion of the bolt 121 in the back and forth direction is permitted. Meanwhile, when the bolt sear push-up portion 105*c* breaks away from the bolt sear 132, the following takes place: the stopper portion 132*d* is displaced upward by the bolt sear spring 133 and the bolt sear 132 is positioned in an arrest position 132B (the position of the bolt sear 132 indicated by a solid line). The arrest position 132B refers to a position where the stopper portion interferes with the path of the movement of the locking projection 121*f* of the bolt 121 and the reciprocating motion of the bolt 121 is arrested.

Figure 6:
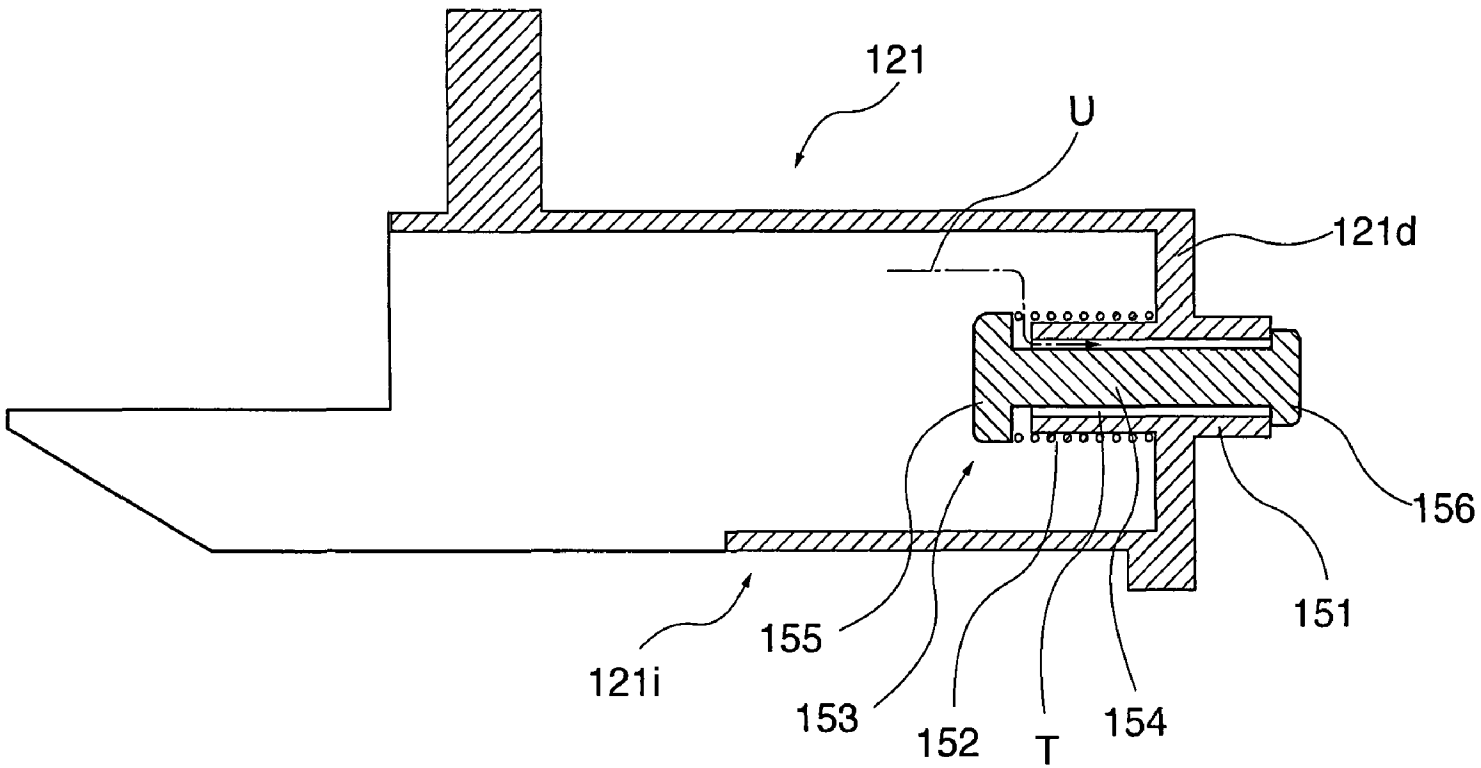
FIG. 6 is a left sectional view of a bolt in the first embodiment.

More detailed description will be given to the structure of the bolt 121 with reference to FIG. 6 to FIG. 11. FIG. 6 is a left sectional view of the bolt 121. As mentioned above, the bolt 121 is a cylindrical member. While it reciprocates once in the back and forth direction of the gunbarrel, the bolt is abutted against and breaks away from the slide projection 123*b* of the discharge valve 123. It thereby moves the discharge valve 123 forward and backward to open and shut the communication between the barrel 113 and the air chamber 126. The bolt 121 has the fit receiving portion 121*i* and the outer circumferential surface of the valve body 122 on the rear side is fit into this fit receiving portion 121*i* in process of the bolt 121 sliding forward.

The closed end 121*d* that forms the bottom portion of the bolt 121 is provided with a cylindrical body 151 as a communicating portion. The cylindrical body 151 is protruded from the closed end 121*d* of the bolt 121 both in the forward direction and in the backward direction. It lets the interior of the fit receiving portion 121*i* and the exterior of the bolt 121 communicate with each other. Inside the fit receiving portion 121*i*, an opening/closing body spring 152 is attached to the cylindrical body 151. The opening/closing body spring 152 is a linear coil and is so placed that it is wound around the cylindrical body 151.

The cylindrical body 151 has an opening/closing body 153 attached thereto. The opening/closing body 153 includes a shank 154, a lid portion 155, and a coming-off preventing portion 156. The shank 154 is a rod-like member extended in the back and forth direction of the gunbarrel and its diameter is smaller than the inside diameter of the cylindrical body 151 and its length is larger than the length of the cylindrical body 151. The shank 154 is inserted into the cylindrical body 151 and can freely slide in the back and forth direction of the gunbarrel. The shank 154 forms an air gap T between it and the inner circumferential surface of the cylindrical body 151. The lid portion 155 is a disk-like member having a size sufficient to cover an end face of the cylindrical body 151. The lid portion 155 is provided at the front end of the shank 154. The coming-off preventing portion 156 is a member provided at the rear end of the shank 154. When the shank 154 moves forward, the coming-off preventing portion 156 hitches on the end face of the cylindrical body 151 and prevents the opening/closing body 153 from coming off forward. In this embodiment, the shank 154 and the lid portion 155 are integrally formed. The coming-off preventing portion 156 has a hook portion (not shown) protruded to the left side (forward) in FIG. 6. The shank 154 is a hollow cylinder and has a hook receiving portion (not shown) formed therein, on which the hook portion of the coming-off preventing portion 156 is hooked.

The opening/closing body 153 and the opening/closing body spring 152 are attached to the bolt 121 as described below. First, a worker attaches the opening/closing body spring 152 around the cylindrical body 151 protruded inward of the bolt 121. Subsequently, the worker inserts the shank 154 into the cylindrical body 151 protruded inward of the bolt 121 and positions the shank 154 and the lid portion 155 inside the bolt 121. Next, the worker fits the hook portion (not shown) of the coming-off preventing portion 156 onto the shank 154 protruded from the end of the cylindrical body 151 outside the bolt 121. As a result, as illustrated in FIG. 6, the opening/closing body spring 152 pushes the opening/closing body 153 forward and causes the lid portion 155 to break away from an end face of the cylindrical body 151. Thus the space in the fit receiving portion 121*i* and the air gap T between the shank 154 and the inner circumferential surface of the cylindrical body 151 are connected with each other. That is, the gas flow path U illustrated in FIG. 6 is ensured.

In FIG. 6, the coming-off preventing portion 156 is abutted against the outer end face of the cylindrical body 151. At this time, the strength of the opening/closing body spring 152 is at such a level that the following is implemented when the pressure of compressed gas flowing in toward the fit receiving portion 121*i* is slightly larger than the atmospheric pressure: this pressure of the compressed gas pushes the surface of the coming-off preventing portion 156 facing toward the cylindrical body 151 and moves this coming-off preventing portion 156 backward.

As a modification, the coming-off preventing portion 156 may break away from the outer end face of the cylindrical body 151.

Figure 7:
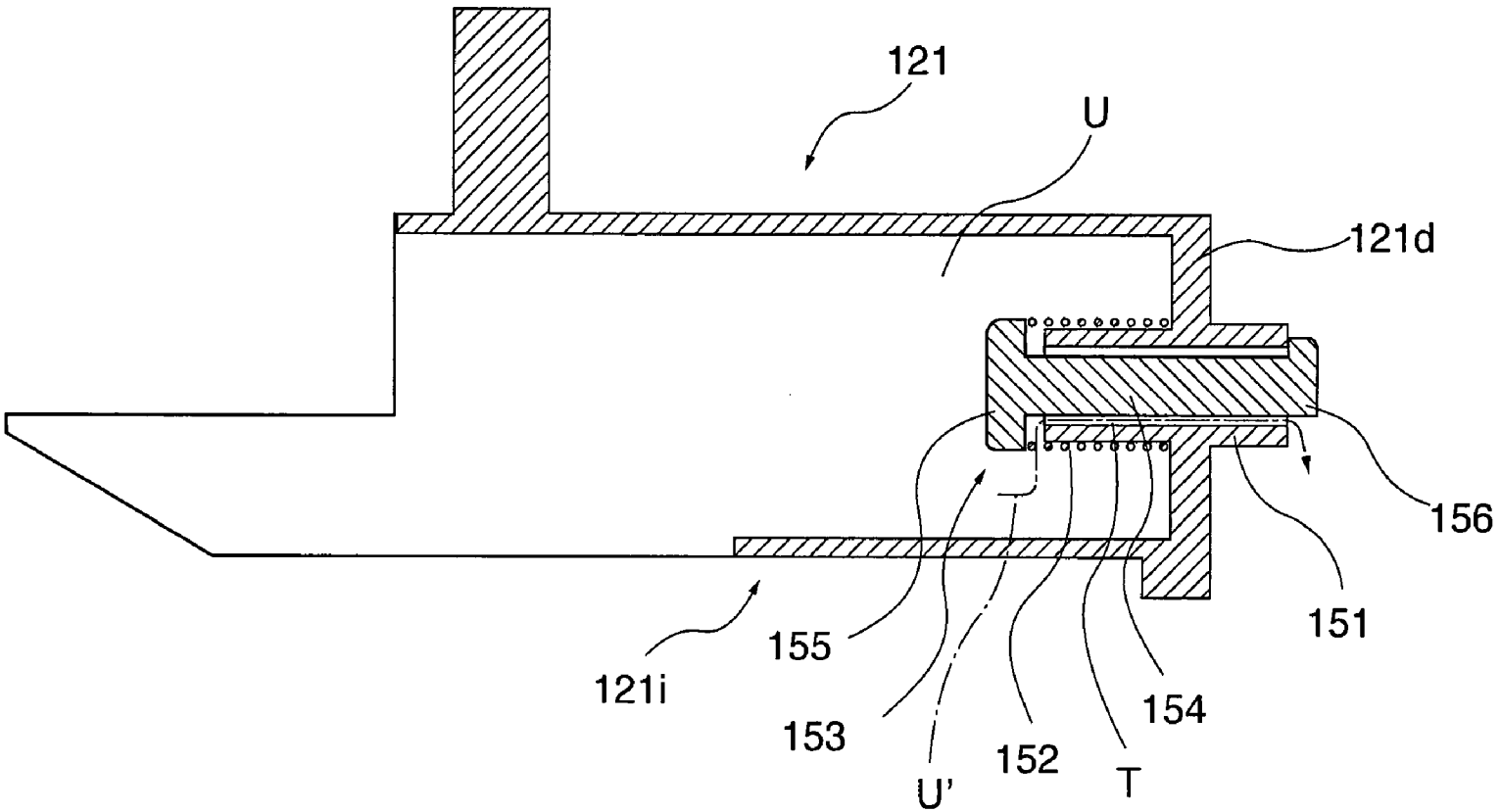
FIG. 7 is a left sectional view illustrating a modification to the bolt in the first embodiment.

FIG. 7 is a left sectional view illustrating a modification to the bolt 121. As illustrated in FIG. 7, one in such a shape that it covers part of the outer end face of the cylindrical body 151 may be adopted as the coming-off preventing portion 156. In the case, the following takes place when the opening/closing body spring 152 pushes the lid portion 155 forward: the space in the fit receiving portion 121*i*, the air gap T between the shank 154 and the inner circumferential surface of the cylindrical body 151, and the space outside the bolt 121 are connected with one another. That is, the flow path U' illustrated in FIG. 7 is ensured.

Figure 8:
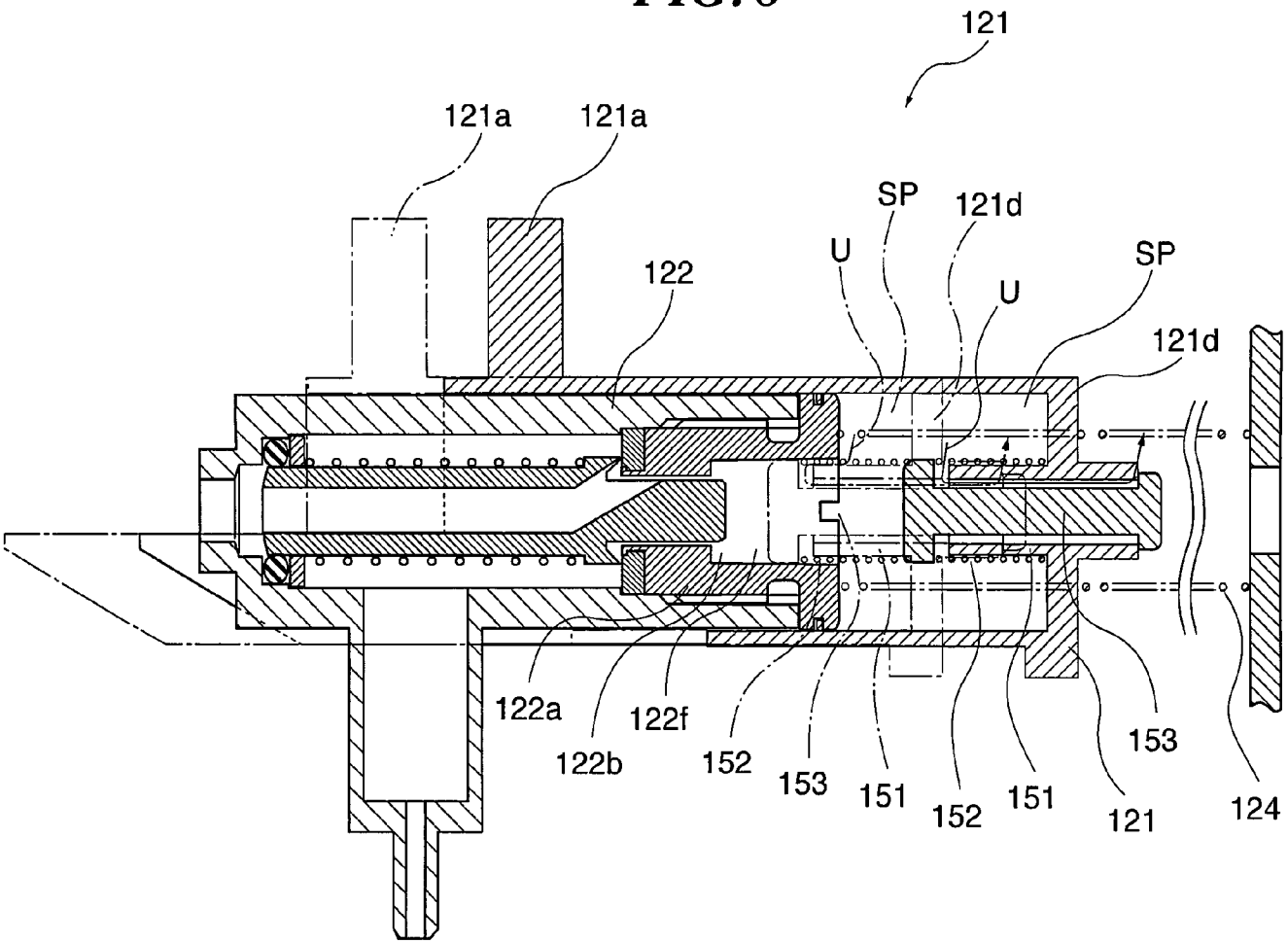
FIG. 8 is a left sectional view illustrating the action of a bolt relative to a valve body in the first embodiment.

FIG. 8 is a left sectional view illustrating the action of the bolt 121 relative to the valve body 122. The bolt 121 is pushed by the bolt spring 124 and linearly slides and moves forward of the toy gun 101. At the closed end 121*d* of the bolt 121, the cylindrical body 151 is protruded forward in a position where it is located behind the fitting hole 122*f* in the rear lid 122*a*. The outside diameter of the cylindrical body 151 is smaller than the inside diameter of the fitting hole 122*f* and has such a shape that it can enter the fitting hole 122*f*. The outside diameter of the opening/closing body 153 is substantially the same as the inside diameter of the fitting hole 122*f* and can enter the fitting hole 122*f*. When the bolt 121 advances forward, the cylindrical body 151 and the opening/closing body spring 152 enter the fitting hole 122*f* forming part of the through hole 122*b*.

Here, it is important that the following is implemented even though the volume of the space SP encircled by the fit receiving portion 121*i* and the rear lid 122*a* of the valve body 122 is reduced with the forward movement of the bolt 121: the air in this space SP is discharged to outside the bolt 121 through the flow path U. As a result, the momentum of the advance of the bolt 121 pushed by the bolt spring 124 is not suppressed by the air in the fit receiving portion 121*i*.

Figure 9:
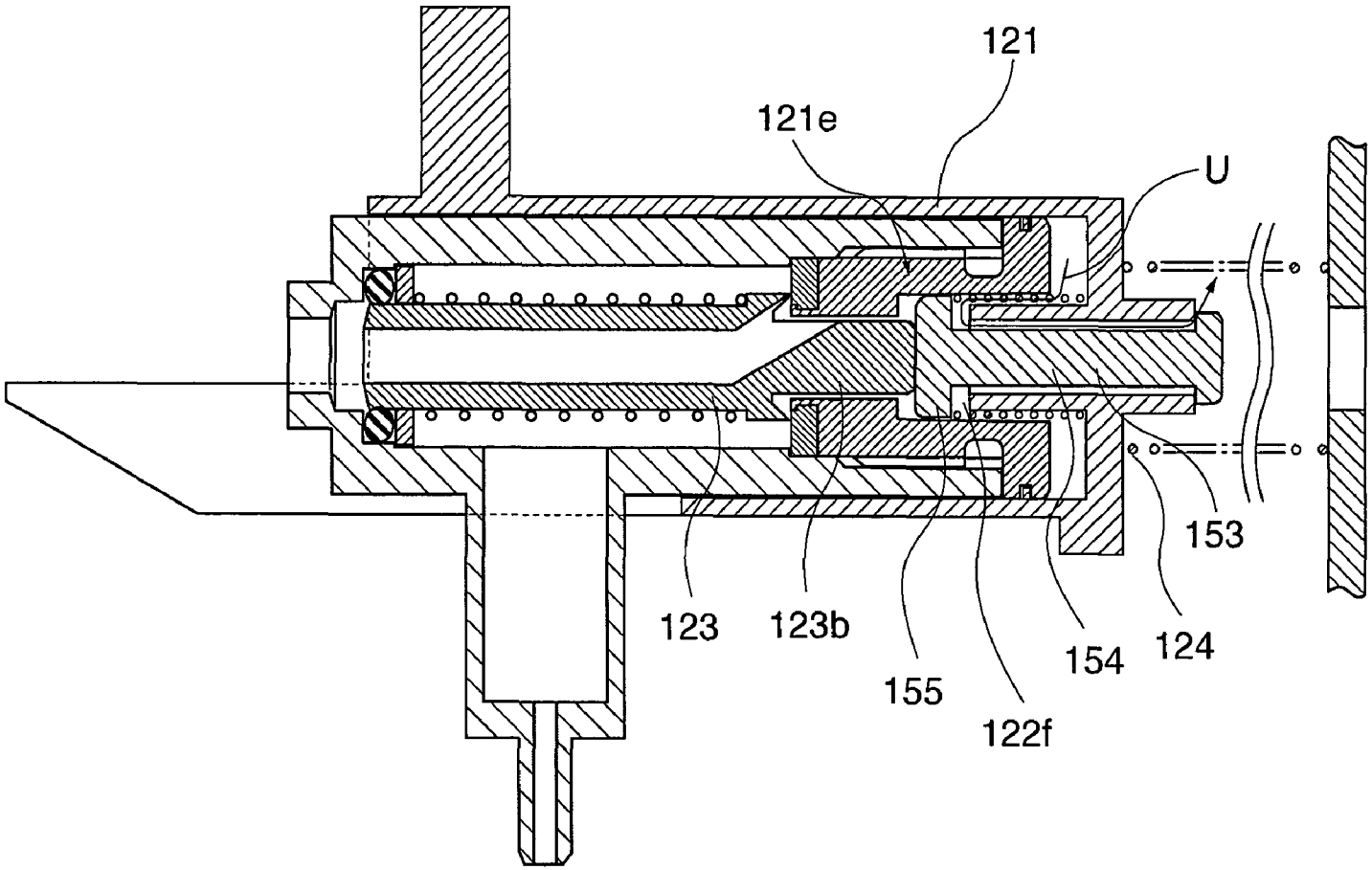
FIG. 9 is a left sectional view illustrating how a lid portion is abutted against a slide projection of a discharge valve, following FIG. 8.

FIG. 9 is a left sectional view illustrating how the lid portion 155 is abutted against the slide projection 123*b* of the discharge valve 123, following FIG. 8. When the bolt spring 124 further pushes the bolt 121 forward, the shank 154 and the lid portion 155 enter the fitting hole 122*f*. Then the lid portion 155 is brought into contact with the slide projection 123*b* of the discharge valve 123. That is, the cylindrical body 151 and the opening/closing body 153 function as the abutment portion 121*e*.

Figure 10:
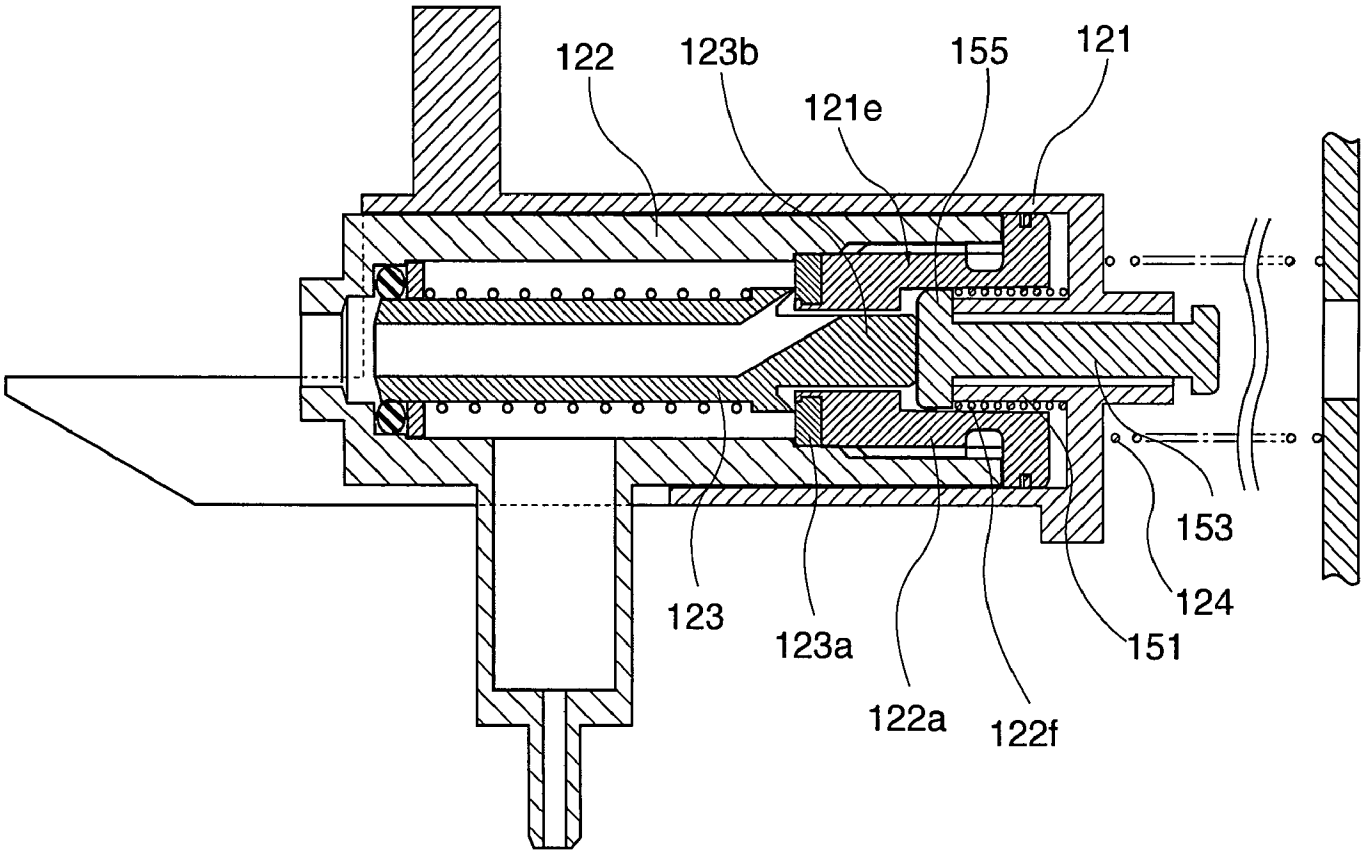
FIG. 10 is a left sectional view illustrating how the lid portion is abutted against the slide projection of the discharge valve, following FIG. 9.

FIG. 10 is a left sectional view illustrating how the lid portion 155 is abutted against the slide projection 123*b* of the discharge valve 123, following FIG. 9. When the bolt spring 124 further pushes the bolt 121 forward, the lid portion 155 pushes the slide projection 123*b* forward. As a result, the discharge valve 123 becomes apt to slide forward in the valve body 122. FIG. 10 illustrates the state immediately before the discharge valve 123 starts to move forward and the flange portion 123*a* has not broken away from the packing 122*c* yet in this drawing.

When the lid portion 155 pushes the slide projection 123*b*, the lid portion 155 is pushed by the slide projection 123*b*. As a result, the opening/closing body 153 slides backward along the cylindrical body 151. Consequently, the lid portion 155 closes the end face of the cylindrical body 151.

Figure 11:
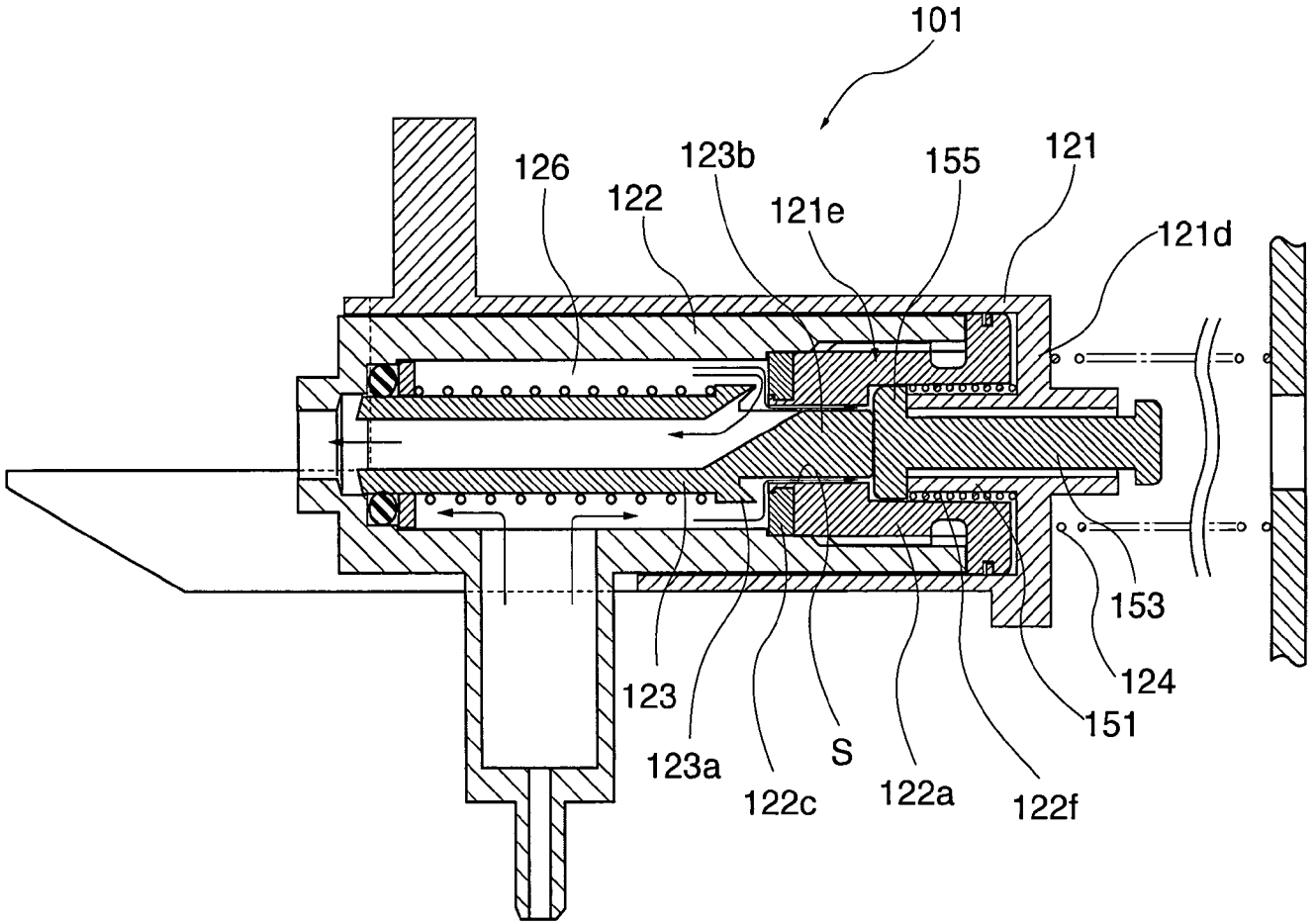
FIG. 11 is a left sectional view illustrating how a flange portion is away from packing, following FIG. 10.

FIG. 11 is a left sectional view illustrating how the flange portion 123*a* is away from the packing 122*c*, following FIG. 10. When the lid portion 155 pushes the slide projection 123*b* of the discharge valve 123 forward, the flange portion 123*a* breaks away from the packing 122*c*. As a result, the compressed gas filled in the air chamber 126 flows backward through the air gap S as indicated by arrows in FIG. 11 and pushes the lid portion 155 and the closed end 121*d* of the bolt 121 backward. This causes the movement of the bolt 121 to shift from advance to retreat.

Here, it is important that such a gap as to form a flow path U is not produced between the lid portion 155 and the cylindrical body 151. For this reason, the compressed gas that goes through the air gap S and pushes the lid portion 155 does not leak to outside the bolt 121 and produces pressure that pushes the bolt 121 backward. This makes it possible for the user of the toy gun 101 to feel high impact from the bolt 121 moving backward.

Description will be given to the action of each part that occurs when a user uses the toy gun 101 with reference to FIG. 2 and FIG. 12 to FIG. 15. First, description will be given with reference to FIG. 2. A user using the toy gun 101 performs operation of pulling the protruded portion 121*a* backward of the toy gun 101. FIG. 2 depicts the internal structure of the toy gun 101 with the bolt 121 positioned backward as mentioned above. When the bolt 121 is positioned backward of the toy gun 101, the forward slope 121*b* of the bolt 121 breaks away from the slope 114*b* of the bullet feed plate 114. Then the bullet feed plate spring 115 pushes the bullet feed plate 114 upward. As a result, the bullet retention hole 114*a* of the bullet feed plate 114 is opposed to the open end 112*d* of the magazine 112. In this state, a bullet B in the magazine 112 is pushed out by the magazine follower 112*c* due to the pushing force of the magazine spring 112*b* and enters the bullet retention hole 114*a* in the bullet feed plate 114.

In process of the bolt 121 moving backward, the locking projection 121*f* of the bolt 121 is abutted against the upper surface of the stopper portion 132*d* of the bolt sear 132 and climbs over the stopper portion 132*d*. After the locking projection 121*f* climbs over the stopper portion 132*d*, the bolt sear 132 is rotated counterclockwise by the elastic force of the bolt sear spring 133. At this time, the bolt 121 becomes apt to move forward of the toy gun 101 by the elastic force of the bolt spring 124. However, the locking projection 121*f* of the bolt 121 hitches on the stopper portion 132*d* and does not move forward any more.

When the user pulls the trigger 105 backward in this state, the trigger 105 rotates counterclockwise and the bolt sear push-up portion 105*c* displaces the forward protruded portion 132*b* of the bolt sear 132 upward to rotate the bolt sear 132 clockwise. This removes the engagement between the locking projection 121*f* of the bolt 121 and the stopper portion 132*d* of the bolt sear 132. Thereafter, the bolt 121 is pushed by the bolt spring 124 and moves forward.

Figure 12:
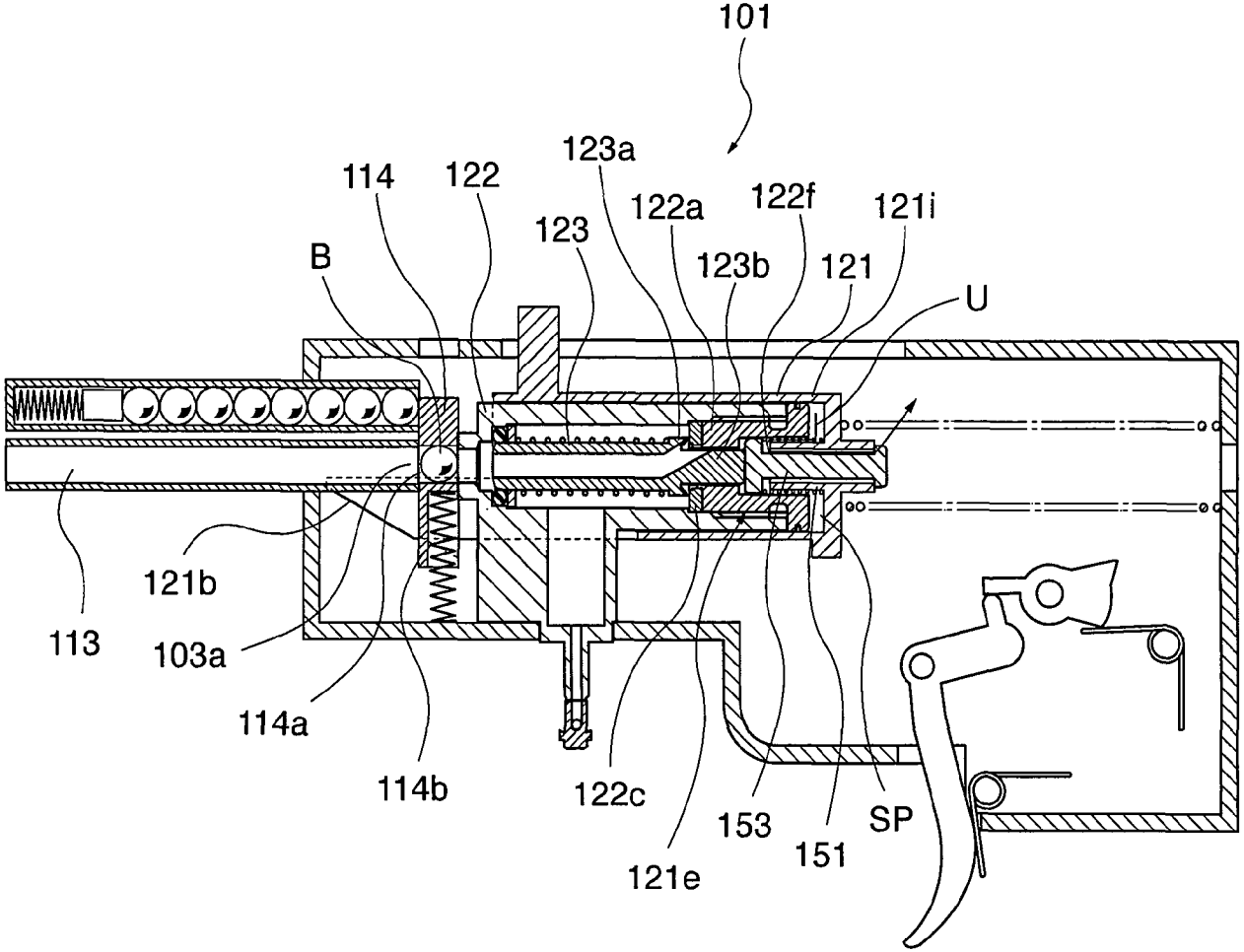
FIG. 12 is a left side view illustrating the internal structure of the toy gun with the bolt moved forward, following FIG. 2.

FIG. 12 is a left side view illustrating the internal structure of the toy gun 101 with the bolt 121 moved forward, following FIG. 2. When the bolt 121 moves forward, the under surface of the forward slope 121*b* slides so that it climbs over the slope 114*b* of the bullet feed plate 114 and pushes the bullet feed plate 114 downward. When the bullet feed plate 114 comes down, the bullet retention hole 114*a* in the bullet feed plate 114 is positioned in the position where it is opposed to the open end 103*a* of the barrel 113. When the bolt 121 moves forward, the following takes place: the abutment portion 121*e* (the cylindrical body 151 and the opening/closing body 153) enters the fitting hole 122*f* in the rear lid 122*a* and pushes the slide projection 123*b* of the discharge valve 123 forward. This causes the flange portion 123*a* to break away from the packing 122*c* and the compressed gas passes forward through the space in the discharge valve 123 and flows into the bullet retention hole 114*a* in the bullet feed plate 114.

As described with reference FIG. 8 to FIG. 11, the following takes place when the bolt 121 moves forward: the air in the space SP encircled by the fit receiving portion 121*i* and the rear lid 122*a* is discharged to outside the bolt 121 through the flow path U. For this reason, the bolt 121 is not decelerated by the air in the space SP and rapidly presses the slide projection 123*b*.

Figure 13:
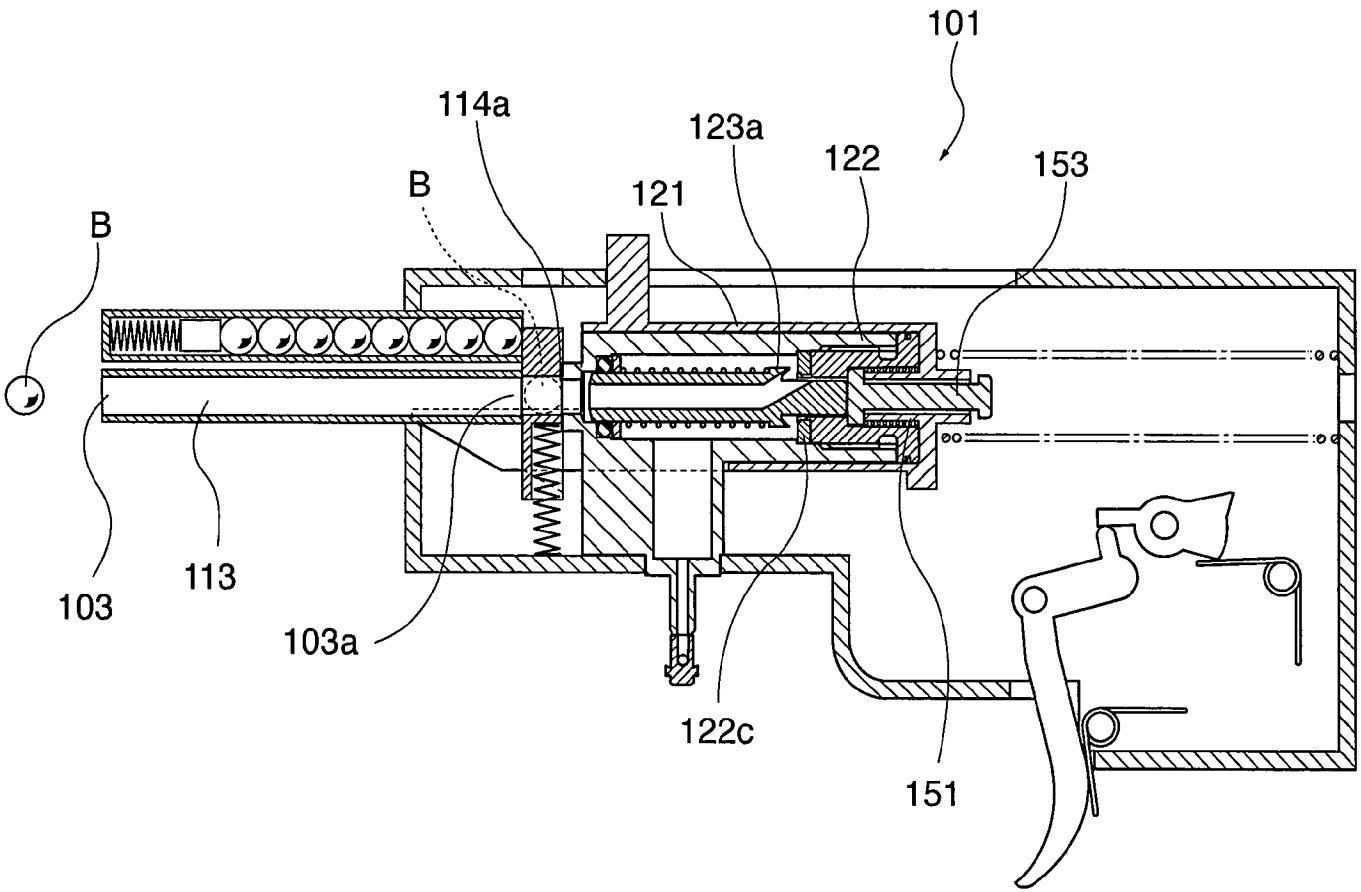
FIG. 13 is a left side view illustrating the internal structure of the toy gun obtained immediately after a bullet B is fired off, following FIG. 12.

FIG. 13 is a left side view illustrating the internal structure of the toy gun 101 obtained immediately after a bullet B is fired off, following FIG. 12. The compressed gas flowing and coming forward of the valve body 122 hits the rear side face of the bullet B positioned in the bullet retention hole 114*a*. Receiving the pressure of the compressed gas, the bullet B moves forward in the barrel 113 and is shot out of the muzzle 103. When the flange portion 123*a* and the packing 122*c* break away from each other, the compressed gas pushes the bolt 121 backward. As described with reference to FIG. 11, the lid portion 155 has closed the cylindrical body 151 at this time. For this reason, the compressed gas pushing the bolt 121 backward does not leak from the cylindrical body 151 to the outside.

Figure 14:
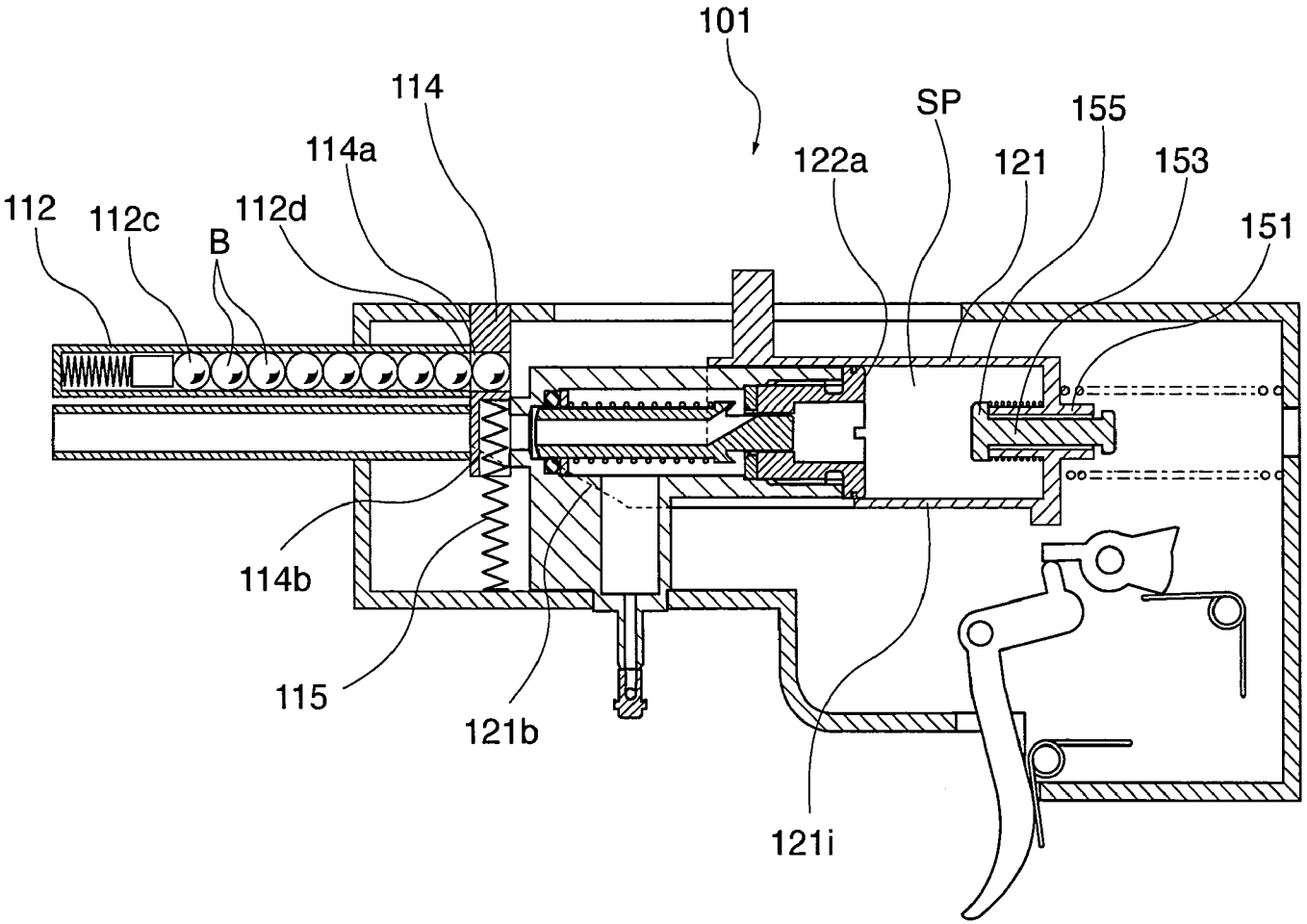
FIG. 14 is a left side view illustrating the internal structure of the toy gun with the bolt moved backward, following FIG. 13.

FIG. 14 is a left side view illustrating the internal structure of the toy gun 101 with the bolt 121 moved backward, following FIG. 13. When the bolt 121 is pushed by the pressure of compressed gas and moves backward, the forward slope 121*b* of the bolt 121 breaks away from the slope 114*b* of the bullet feed plate 114. Consequently, the bullet feed plate spring 115 pushes the bullet feed plate 114 upward. As a result, the bullet retention hole 114*a* is positioned in the position where it is opposed to the open end 112*d* of the magazine 112. A bullet B is pushed by the magazine follower 112*c* and enters the bullet retention hole 114*a*.

The bolt 121 is pushed by compressed gas and rapidly moves backward. At this time, the opening/closing body 153 is kept positioned backward of the cylindrical body 151 and the space SP encircled by the fit receiving portion 121*i* and the rear lid 122*a* does not communicate with the outside. For this reason, the compressed gas that flowed into the space SP is all used as power for pushing the bolt 121 backward.

Figure 15:
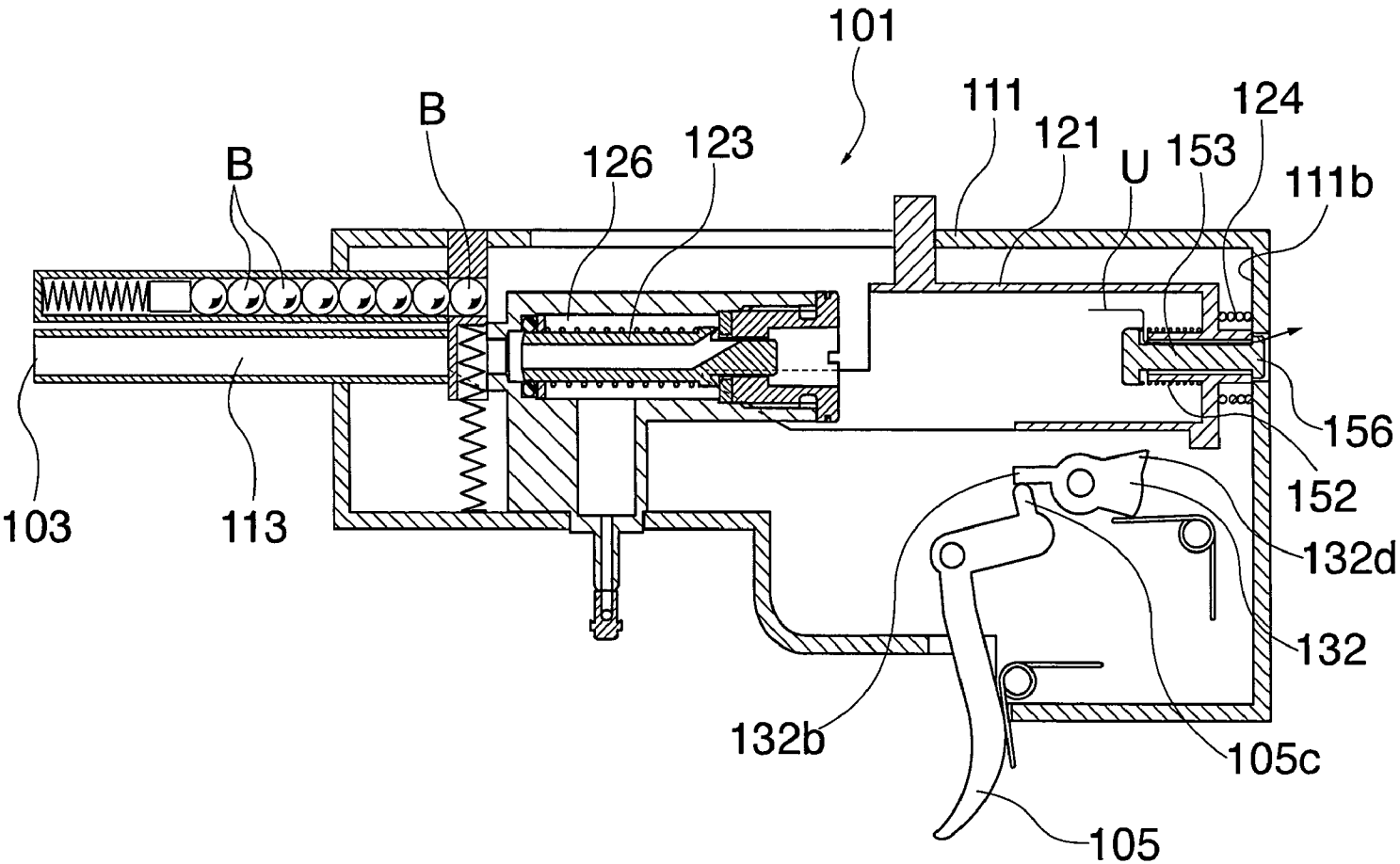
FIG. 15 is a left side view illustrating the internal structure of the toy gun with an opening/closing body moved forward, following FIG. 14.

FIG. 15 is a left side view illustrating the internal structure of the toy gun 101 with the opening/closing body 153 moved forward, following FIG. 14. Before the bolt 121 moves backward of the toy gun 101 as far as it will go, the opening/closing body 153 is displaced forward and the flow path U is formed. This forward displacement of the opening/closing body 153 may be carried out by the elastic force of the opening/closing body spring 152. Or, it may be carried out by the coming-off preventing portion 156 being abutted against the inner surface 111*b* of the rear part of the frame 111.

While the user pulls and keeps the trigger 105 backward, the bolt sear push-up portion 105*c* keeps pushing the forward protruded portion 132*b* of the bolt sear 132 upward. For this reason, the stopper portion 132*d* of the bolt sear push-up portion 105*c* remains downward. As a result, the bolt 121 is not stopped by the bolt sear 132 and moves backward as far as it will go and is then pushed by the bolt spring 124 and starts to move forward in turn. Thus the bolt 121 receives the elastic force of the bolt spring 124 and the pressure of the compressed gas and makes reciprocating motion. While it reciprocates once, it is abutted against and breaks away from the discharge valve 123 to open and shut the communication between the barrel 113 and the air chamber 126. In the toy gun 101, then, the action illustrated in FIG. 2 and FIG. 12 to FIG. 15 is repeated and bullets B are fired off from the muzzle 103 in rapid succession.

In the toy gun 101 in this embodiment, as mentioned above, the following is implemented while the bolt 121 moves forward: the flow path U for discharging the air in the fit receiving portion 121*i* to the outside is ensured; and the air in the fit receiving portion 121*i* flows along the flow path U and is discharged to the outside through the cylindrical body 151. For this reason, impact produced when the bolt 121 pushes the discharge valve 123 is not reduced. When the bolt 121 receives the force of the compressed gas after a bullet B is fired off, the lid portion 155 has closed the cylindrical body 151 and the compressed gas that has flowed into the fit receiving portion 121*i* is not discharged to the outside. For this reason, the pressure of compressed gas pushing the bolt 121 backward is not reduced. This makes it possible to implement the following with the toy gun 101 so configured as to fire off bullets by gas pressure: the impacts produced when bullets B are fired off and at the time of blowback can be made close to those from a real gun and firing of bullets B and the action of blowback can be smoothly carried out.

Description will be given to another embodiment with reference to FIG. 16A and FIG. 16B. This embodiment will be designated as second embodiment for the convenience of explanation. The same elements as in the first embodiment will be marked with the same reference numerals and the description thereof will be omitted.

Figure 16A:
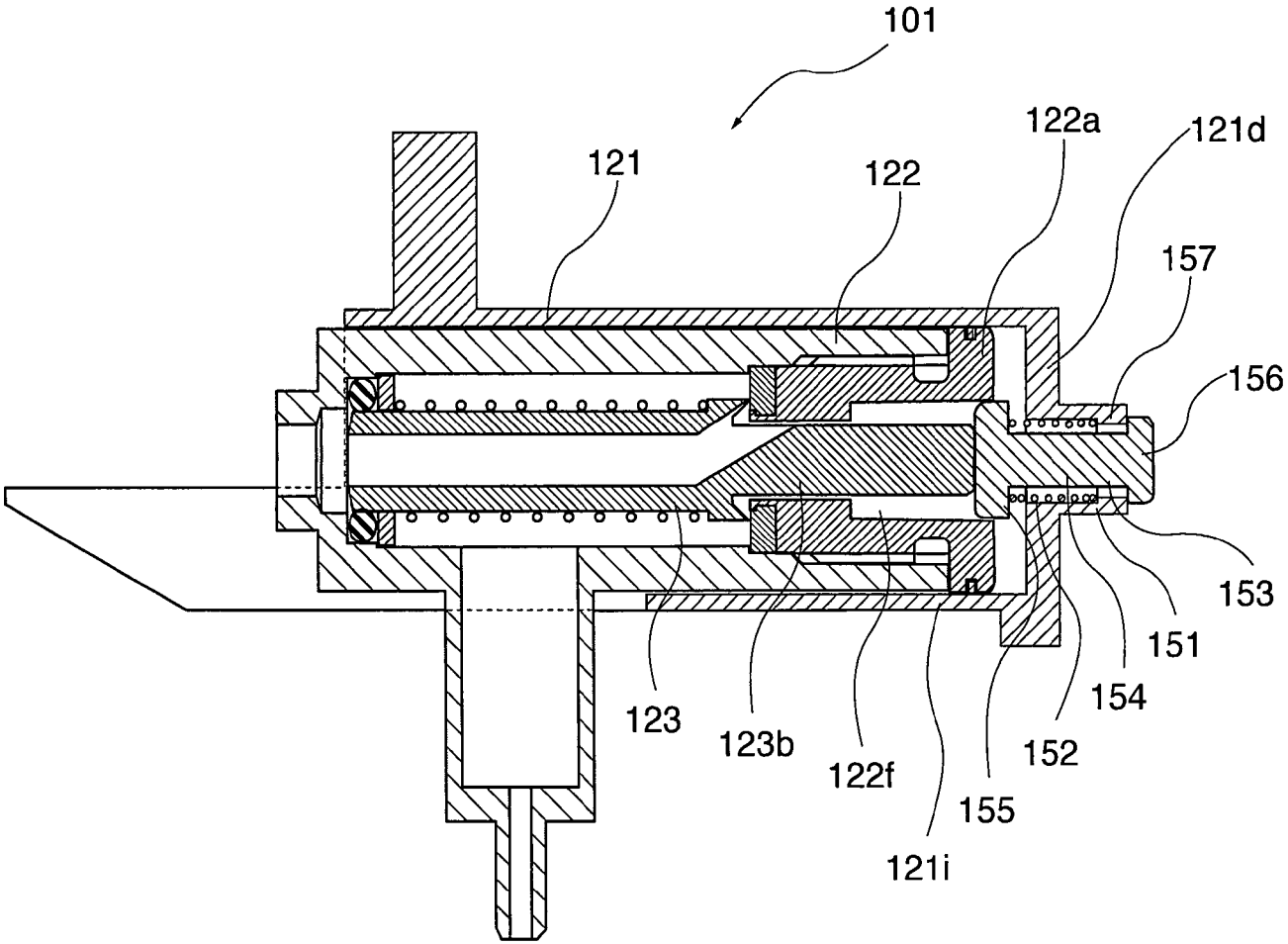
FIG. 16A is a left sectional view of a bolt, a valve body, and a discharge valve, illustrating a state in which a lid portion does not close a cylindrical body in a second embodiment.

FIG. 16A is a left sectional view of the bolt 121, valve body 122, and discharge valve 123, illustrating a state in which the lid portion 155 does not close the cylindrical body 151. In this embodiment, the slide projection 123*b* provided on the discharge valve 123 is protruded to close to the rear end face of the rear lid 122*a* provided on the valve body 122. In this embodiment, the cylindrical body 151 is not protruded inward of the fit receiving portion 121*i*. That is, the end face of the cylindrical body 151 inside the fit receiving portion 121*i* is flush with the inner surface of the closed end 121*d* of the bolt 121.

In this embodiment, further, the cylindrical body 151 has an opening/closing body spring receiving portion 157 at its outer end. The opening/closing body spring receiving portion 157 is protruded inward from the outer end face of the bolt 121 like a ring. One end of the opening/closing body spring 152 is abutted against the lid portion 155 and the other end is abutted against the opening/closing body spring receiving portion 157.

Figure 16B:
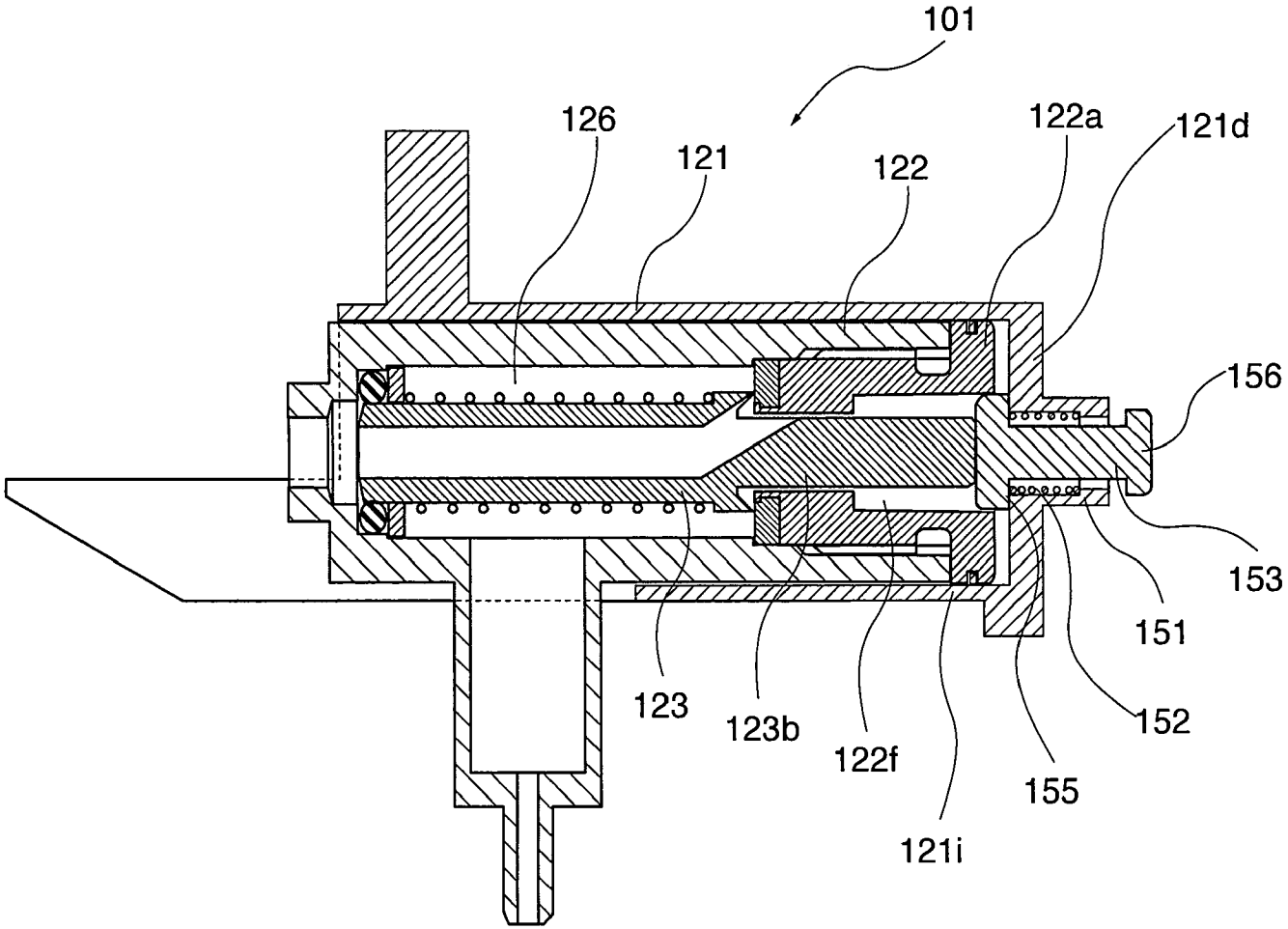
FIG. 16B is a left sectional view of the bolt, valve body, and discharge valve, illustrating a state in which the lid portion closes the cylindrical body 151 in the second embodiment.

FIG. 16B is a left sectional view of the bolt 121, valve body 122, and discharge valve 123, illustrating a state in which the lid portion 155 closes the cylindrical body 151. In this embodiment, the lid portion 155 of the opening/closing body 153 is pushed by the slide projection 123*b* and moves backward and it is brought into contact with the closed end 121*d* of the bolt 121 and closes the cylindrical body 151.

Also in the toy gun 101 in this embodiment, the air in the fit receiving portion 121*i* is discharged to the outside through the cylindrical body 151 when the bolt 121 advances. Meanwhile, when the bolt 121 receives the force of compressed gas after a bullet B is fired off, the compressed gas that has flowed into the fit receiving portion 121*i* is not discharged to the outside. For this reason, the following can be implemented in the toy gun 101 so configured as to fire off bullets by gas pressure: the impacts produced when bullets B are fired off and at the time of blowback can be made close to those from a real gun. In the toy gun 101 in this embodiment, further, the length of the cylindrical body 151 can be reduced and the shank 154 or the lid portion 155 provided in the opening/closing body 153 does not deeply enter the fitting hole 122*f*. For this reason, the structure is simplified and a problem is less prone to occur in the fit receiving portion 121*i* of the bolt 121.

Description will be given to another embodiment with reference to FIG. 17A and FIG. 17B. This embodiment will be designated as third embodiment for the convenience of explanation. The same elements as in the first embodiment or the second embodiment will be marked with the same reference numerals and the description thereof will be omitted.

Figure 17A:
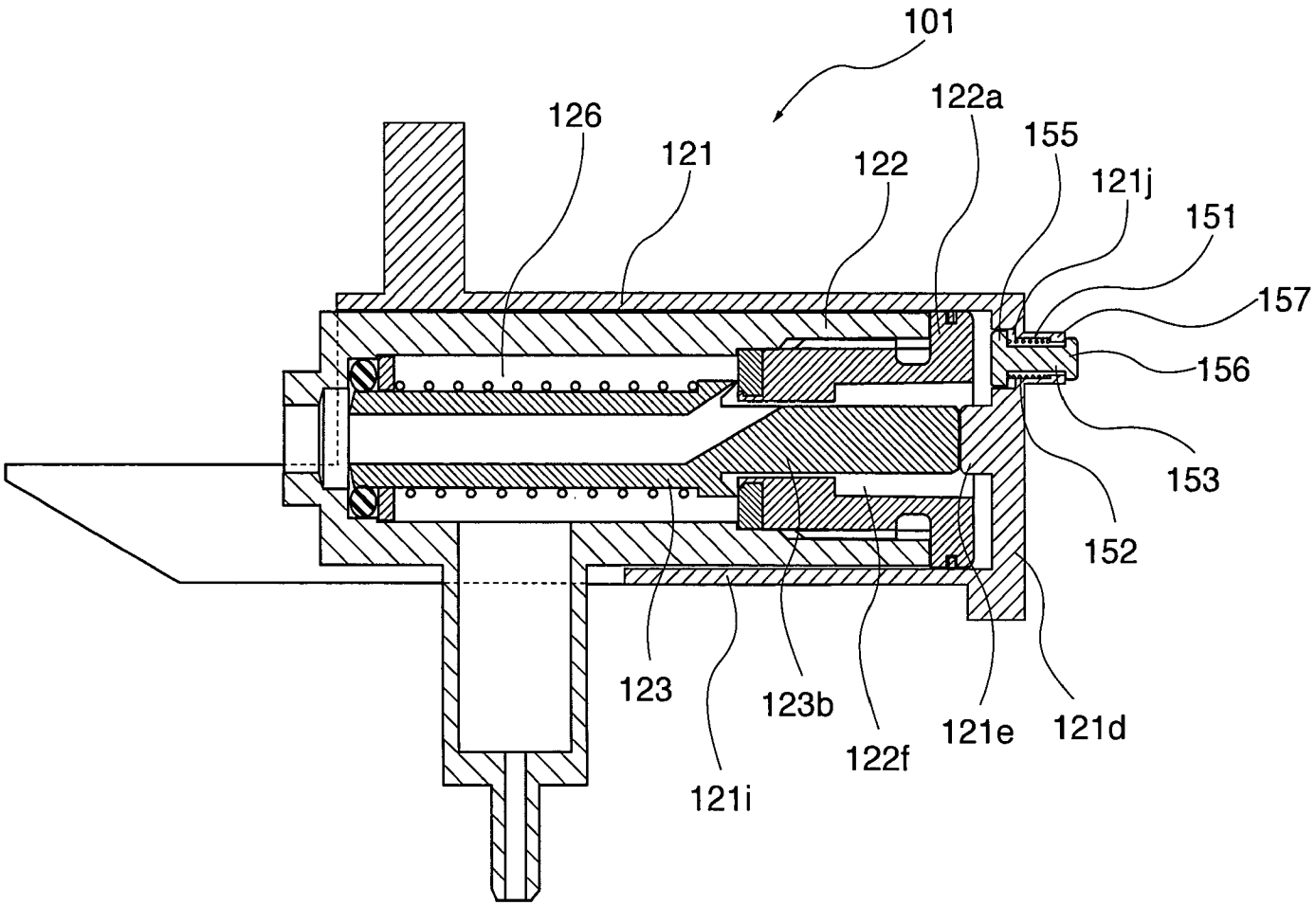
FIG. 17A is a left sectional view illustrating a bolt, a valve body, and a discharge valve, illustrating a state in which a lid portion does not close a cylindrical body in a third embodiment.

FIG. 17A is a left sectional view of the bolt 121, valve body 122, and discharge valve 123, illustrating a state in which the lid portion 155 does not close the cylindrical body 151. In this embodiment, the abutment portion 121*e* is a projection protruded forward from the closed end 121*d* toward inside the fit receiving portion 121*i*. The cylindrical body 151 is provided at the closed end 121*d* of the bolt 121 in a place shifted from the abutment portion 121*e*. That is, in this embodiment, the cylindrical body 151 or the opening/closing body 153 does not enter the fitting hole 122*f* even when the bolt 121 moves forward and does not function as the abutment portion 121*e*.

In this embodiment, the closed end 121*d* has a recessed portion 121*j* in its inner surface. The recessed portion 121*j* is recessed from the closed end 121*d* backward of the toy gun 101. The lid portion 155 of the opening/closing body 153 is positioned in the recessed portion 121*j*. The opening/closing body spring 152 pushes the lid portion 155 forward and positions the front surface of the lid portion 155 in a position where it is flush with the inner surface of the closed end 121*d*.

Figure 17B:
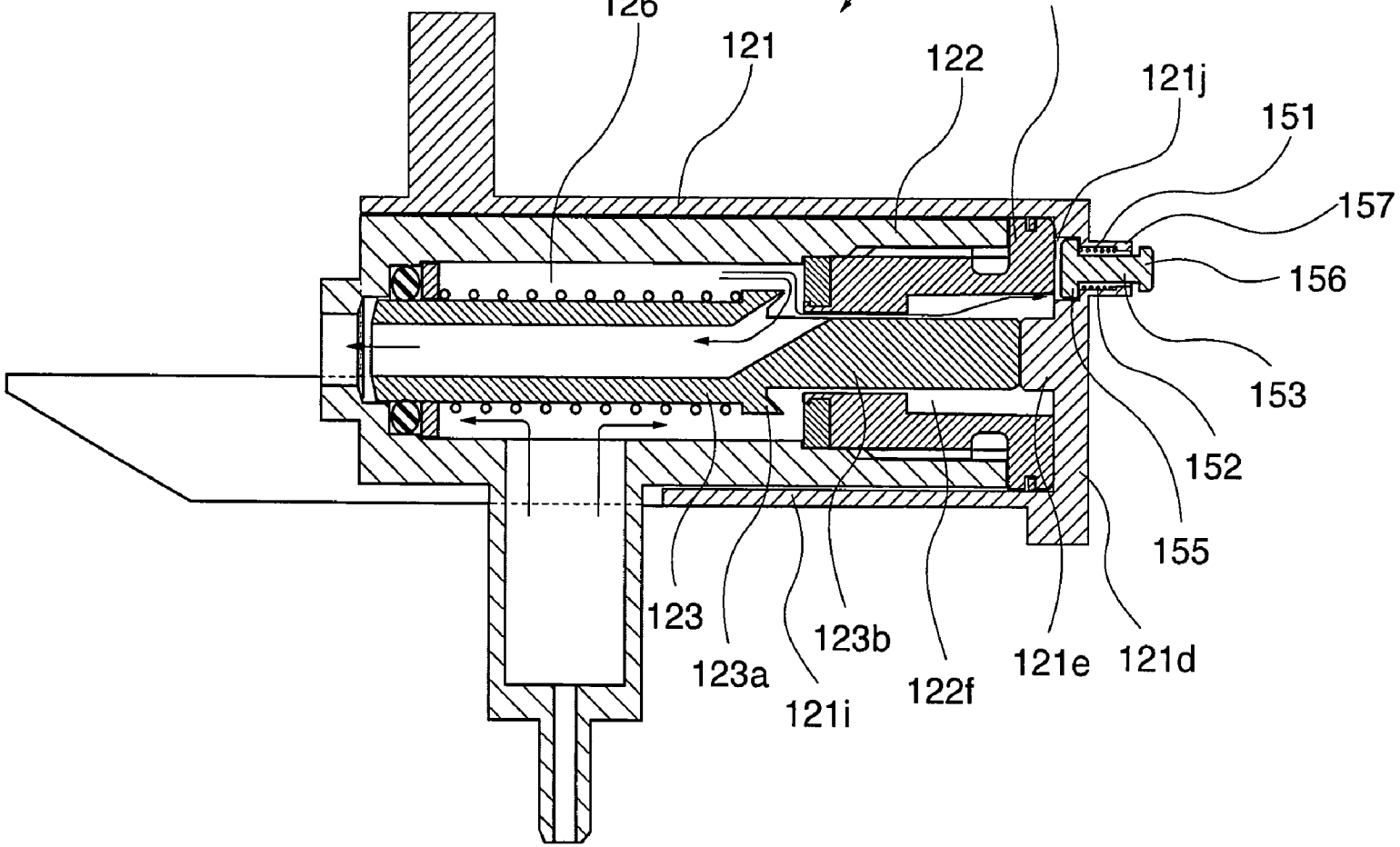
FIG. 17B is a left sectional view of the bolt, valve body, and discharge valve, illustrating a state in which an abutment portion pushes a slide projection of a discharge valve in the third embodiment.

FIG. 17B is a left sectional view of the bolt 121, valve body 122, and discharge valve 123, illustrating a state in which the abutment portion 121*e* has pushed the slide projection 123*b* of the discharge valve 123. In this embodiment, the following takes place when the flange portion 123*a* of the discharge valve 123 and the packing 122*c* break away from each other: when the compressed gas in the air chamber 126 flows backward, the pressure in the space encircled by the rear lid 122*a* and the bolt 121 is made much higher than the atmospheric pressure by the compressed gas. When carbon dioxide gas is used for the compressed gas, for example, the pressure in the space encircled by the rear lid 122*a* and the fit receiving portion 121*i* of the bolt 121 becomes 70 atmospheres or higher. As a result, the compressed gas pushes the lid portion 155 of the cylindrical body 151 backward and the lid portion 155 is brought into contact with the bottom face of the recessed portion 121*j* and closes the cylindrical body 151. Meanwhile, when the action of the bolt 121 is shifted to advance, the pressure in the space encircled by the rear lid 122*a* and the fit receiving portion 121*i* of the bolt 121 is at a level slightly higher than the atmospheric pressure. The atmospheric pressure in this case is much lower than the pressure arising from the compressed gas when the bolt moves backward. For this reason, the opening/closing body 153 is pushed forward by the opening/closing body spring 152 and the opening/closing body 153 does not completely close the cylindrical body 151.

Also in the toy gun 101 in this embodiment, the air in the fit receiving portion 121*i* is discharged to the outside through the cylindrical body 151 when the bolt 121 advances. For this reason, ahead power is not diminished. Meanwhile, when the bolt 121 receives the force of compressed gas after a bullet B is fired off, the compressed gas that has flowed into the fit receiving portion 121*i* is not discharged to the outside. For this reason, the following can be implemented in the toy gun 101 so configured as to fire off bullets by gas pressure: the impacts produced when bullets B are fired off and at the time of blowback can be made close to those from a real gun. In the toy gun 101 in this embodiment, further, the structure of the following area is simplified: the area where the slide projection 123*b* of the discharge valve 123 and the abutment portion 121*e* of the bolt 121 collide with each other in the fit receiving portion 121*i*. Therefore, a problem is less prone to occur in this area.

In the above description, the continuous firing toy gun 101 has been taken as examples of the first embodiment, second embodiment, and third embodiment. As other embodiments, the cylindrical body 151, opening/closing body spring 152, and opening/closing body 153 can also be applied to single firing toy guns and burst toy guns.

Obviously, numerous modifications and variations of the present invention are possible in light of the above teachings. It is therefore to be understood that within the scope of the appended claims, the invention may be practiced otherwise than as specifically described herein.

What is claimed is:

1. A toy gun comprising:

a barrel extended in the back and forth direction of a gunbarrel;

a valve body formed in the shape of a cylinder extended in the back and forth direction of the gunbarrel, having an air chamber to be filled with compressed gas formed therein, communicating with the rear-side end of the barrel on the front side, and having a through hole penetrating the valve body in the back and forth direction of the gunbarrel formed on the rear side;

a discharge valve positioned in the valve body and so provided that the discharge valve can be displaced between a closed position where the communication between the barrel and the air chamber is shut and an open position, located in front of the closed position, where the communication between the barrel and the air chamber is opened;

a discharge valve spring pushing the discharge valve backward and positioning the discharge valve in the closed position;

a bolt provided so that the bolt can freely slide in the back and forth direction of the gunbarrel, including a fit receiving portion which has an opening and to which the outer circumferential surface of the valve body on the rear side is fit through the opening and an abutment portion provided on the bottom portion of the fit receiving portion opposite the opening, and displaced between a pressing position where the abutment portion is abutted against the discharge valve and the discharge valve is positioned in the open position and a retreat position, behind this pressing position, where the abutment portion is caused to break away from the discharge valve;

a bolt spring pushing the bolt forward;

a communicating portion provided at the bottom portion of the bolt;

an opening/closing body including a slidable shank which is inserted into the communicating portion and forms an air gap between the shank and the inner circumferential surface of the communicating portion, a lid portion which is provided at the front end of the shank and has such a shape as to cover the communicating portion, and a coming-off preventing portion which is provided on the shank and prevents the opening/closing body from coming off forward; and an opening/closing body spring pushing the opening/closing body forward.

2. The toy gun of claim 1, wherein:

the communicating portion is a cylindrical body protruded forward from the bottom portion of the bolt, and the opening/closing body spring is so placed that the opening/closing body spring is wound around the cylindrical body.

3. The toy gun of claim 2, wherein:

at least either of the cylindrical body and the opening/closing body is abutted against the discharge valve and positions the discharge valve in the open position.

* * * * *